US009367026B2

(12) United States Patent
Nakashima

(10) Patent No.: US 9,367,026 B2
(45) Date of Patent: Jun. 14, 2016

(54) IMAGE FORMING APPARATUS HAVING CASING FOR MAINTAINING RELATIVE POSITIONS OF PHOTOSENSITIVE DRUMS

(71) Applicant: Atsuhisa Nakashima, Obu (JP)

(72) Inventor: Atsuhisa Nakashima, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 121 days.

(21) Appl. No.: 14/032,923

(22) Filed: Sep. 20, 2013

(65) Prior Publication Data

US 2014/0086622 A1 Mar. 27, 2014

(30) Foreign Application Priority Data

Sep. 21, 2012 (JP) ..... 2012-208912

(51) Int. Cl.
*G03G 15/00* (2006.01)
*G03G 21/16* (2006.01)

(52) U.S. Cl.
CPC ..... *G03G 21/1661* (2013.01); *G03G 21/1619* (2013.01)

(58) Field of Classification Search
None
See application file for complete search history.

(56) References Cited

U.S. PATENT DOCUMENTS

| | | | |
|---|---|---|---|
| 3,638,112 | A | 1/1972 | Lasater et al. |
| 5,765,082 | A | 6/1998 | Numazu et al. |
| 6,708,011 | B2 | 3/2004 | Nomura et al. |
| 6,721,521 | B2 | 4/2004 | Kataoka et al. |
| 7,706,716 | B2 | 4/2010 | Tada et al. |
| 7,715,752 | B2 | 5/2010 | Sakurai et al. |
| 7,826,773 | B2 | 11/2010 | Kawamura |
| 7,899,360 | B2 | 3/2011 | Kondo et al. |
| 7,937,020 | B2 | 5/2011 | Sakurai et al. |
| 7,957,670 | B2 | 6/2011 | Kondo et al. |
| 8,056,894 | B2 | 11/2011 | Ichikawa |
| 8,126,366 | B2 | 2/2012 | Hattori |

(Continued)

FOREIGN PATENT DOCUMENTS

| | | | |
|---|---|---|---|
| EP | 1058161 | A1 | 12/2000 |
| EP | 1816527 | A2 | 8/2007 |

(Continued)

OTHER PUBLICATIONS

Dec. 29, 2014—(US) Non-final Office Action—U.S. Appl. No. 14/032,988.

(Continued)

*Primary Examiner* — David Gray
*Assistant Examiner* — Geoffrey Evans
(74) *Attorney, Agent, or Firm* — Banner & Witcoff, Ltd.

(57) ABSTRACT

An image forming apparatus includes a casing, a plurality of photosensitive drums, and a plurality of developing device. The casing includes a first frame and a second frame. The plurality of photosensitive drums is configured to rotate about an axis line extending in an axial direction and juxtaposed at intervals in the casing. The casing defines one side and the other side in the axial direction. Drive force for rotating the plurality of photosensitive drums is inputted to the one side of the plurality of photosensitive drums. The plurality of developing device is provided to correspond to the plurality of photosensitive drums and configured to supply developing agent to the corresponding photosensitive drum. The first frame is made of metal and is configured to support the one side of each of the plurality of photosensitive drums, and the second frame is made of resin and is configured to support the other side of each of the plurality of photosensitive drums.

15 Claims, 24 Drawing Sheets

(56) References Cited

U.S. PATENT DOCUMENTS

2001/0019418 A1 9/2001 Kataoka et al.
2003/0161656 A1 8/2003 Miura et al.
2007/0110473 A1 5/2007 Kondo et al.
2007/0160384 A1 7/2007 Sakurai et al.
2007/0177899 A1 8/2007 Kawamura
2007/0280730 A1 12/2007 Okabe et al.
2007/0280733 A1 12/2007 Shiraki et al.
2007/0286632 A1 12/2007 Okabe
2008/0002341 A1* 1/2008 Tomatsu ..... 361/679
2008/0003015 A1* 1/2008 Tomatsu ..... 399/110
2008/0075502 A1 3/2008 Tada et al.
2008/0159774 A1 7/2008 Tanabe et al.
2009/0123181 A1 5/2009 Ito et al.
2009/0169247 A1 7/2009 Hattori
2009/0202272 A1* 8/2009 Nakashima ..... G03G 15/326 399/117
2010/0111562 A1 5/2010 Okabe et al.
2010/0209139 A1 8/2010 Sakurai et al.
2011/0013935 A1 1/2011 Kondo et al.
2011/0102983 A1* 5/2011 Souda et al. ..... 361/679.01
2011/0164897 A1 7/2011 Kikuchi
2012/0114376 A1 5/2012 Kawamura
2012/0195633 A1* 8/2012 Okabe ..... G03G 21/1619 399/110
2012/0251172 A1* 10/2012 Hashimoto ..... G03G 21/1619 399/117
2012/0275822 A1 11/2012 Kawamura
2014/0010569 A1* 1/2014 Souda ..... G03G 21/1839 399/107
2014/0093279 A1* 4/2014 Hayakawa ..... G03G 21/1821 399/117
2014/0294437 A1* 10/2014 Okabe ..... G03G 15/0194 399/110
2014/0376944 A1* 12/2014 Souda ..... G03G 21/1619 399/90
2014/0376945 A1* 12/2014 Souda ..... G03G 21/1619 399/90
2014/0376946 A1* 12/2014 Souda ..... G03G 21/16 399/90
2014/0376947 A1* 12/2014 Nishimura ..... G03G 21/1619 399/90
2014/0376957 A1* 12/2014 Souda ..... G03G 21/1619 399/107
2014/0376958 A1* 12/2014 Souda ..... G03G 21/1619 399/107
2015/0139679 A1* 5/2015 Souda ..... G03G 21/1652 399/90
2015/0139687 A1* 5/2015 Souda ..... G03G 21/1671 399/107
2015/0177677 A1* 6/2015 Souda ..... G03G 21/1619 399/107
2015/0177678 A1* 6/2015 Souda ..... G03G 21/1619 399/107
2015/0177679 A1* 6/2015 Souda ..... G03G 21/1619 399/107
2015/0177680 A1* 6/2015 Souda ..... G03G 21/1619 399/107
2015/0261174 A1* 9/2015 Souda ..... G03G 21/1619 399/107
2016/0009510 A1* 1/2016 Kawai ..... B65H 1/04 271/264

FOREIGN PATENT DOCUMENTS

JP 08-305184 A 11/1996
JP 09-281770 A 10/1997
JP 11-084799 A 3/1999
JP 2000-181329 A 6/2000
JP 2001-249517 A 9/2001
JP 2003-015378 A 1/2003
JP 2003-316233 A 11/2003
JP 2006-184901 A 7/2006
JP 2007-140041 A 6/2007
JP 2007-213023 A 8/2007
JP 2007-213033 A 8/2007
JP 2008-065122 A 3/2008
JP 2009-162915 A 7/2009
JP 2010-052423 A 3/2010
JP 2010-107890 A 5/2010
JP 2011-065030 A 3/2011
JP 2011-215406 A 10/2011
JP 4867955 B2 2/2012

OTHER PUBLICATIONS

Office Action received in corresponding Chinese Patent Application 200910205932.9 mailed Jun. 1, 2012.
Office Action received in corresponding Chinese Patent Application 200910205932.9 mailed May 25, 2011.
Extended European Search Report for application No. 09174172.8 mailed Nov. 24, 2010.
Office Action received in corresponding Japanese Patent Application No. 2008-281992 mailed Sep. 7, 2010.
Office Action received in corresponding Japanese Patent Application No. 2008-281993 mailed Sep. 7, 2010.
Office Action received in corresponding Japanese Patent Application 2008-281991 mailed Aug. 17, 2010.
Copending U.S. Appl. No. 14/032,988, filed Sep. 20, 2013.
Office Action received in U.S. Appl. No. 12/606,660, mailed May 15, 2012.
Office Action received in U.S. Appl. No. 12/606,660, mailed Aug. 28, 2012.
Notice of Allowance received in U.S. Appl. No. 12/606,660 mailed Jun. 28, 2013.
Apr. 7, 2015—(US) Non-Final Office Action—U.S. Appl. No. 14/053,143.
Apr. 6, 2016—(CN) Office Action—App 201310428796.6—Eng Tran.

* cited by examiner

IMAGE FORMING APPARATUS HAVING CASING FOR MAINTAINING RELATIVE POSITIONS OF PHOTOSENSITIVE DRUMS

CROSS REFERENCE TO RELATED APPLICATION

This application claims priority from Japanese Patent Application No. 2012-208912 filed Sep. 21, 2012. The entire content of this priority application is incorporated herein by reference.

TECHNICAL FIELD

The present invention relates to an image-forming apparatus employing an electrophotographic system.

One electrophotographic image-forming apparatus known in the art is a tandem-type color electrophotographic printer provided with a case, and four photosensitive drums corresponding to the four colors yellow, magenta, cyan, and black employed by the printer. The photosensitive drums are arranged parallel to each other and juxtaposed in the case. This type of printer has a metal frame disposed in the case tor positioning each of the photosensitive drums.

One example of this type of tandem color printer that has been proposed includes a front pitch-setting member and a rear pitch-setting member each configured of metal plates and are disposed one on either side of the photosensitive drums with respect to the axial direction thereof. The front axial ends of the photosensitive drums contact the front pitch-setting member, while the rear axial ends contact the rear pitch-setting member, thereby fixing the positions of the photosensitive drums in their juxtaposed direction.

BACKGROUND

Here, the front and rear pitch-setting members provided in the conventional printer described above are formed of metal plates. Thus, the members have good rigidity and can maintain the relative positions of the photosensitive drums with precision. The drawbacks to using metal plates for the front and rear pitch-setting members are the higher material costs and increased weight. Thus, reducing material costs and weight is difficult in a printer provided with such front and rear pitch-setting members.

In view of the foregoing, it is an object of the present invention to provide an image-forming apparatus having a structure that allows for lower material costs and reduced weight while being capable of maintaining the relative positions of photosensitive drums constant.

SUMMARY

In order to attain the above and other objects, the invention provides an image forming apparatus. The image forming, apparatus includes a casing, a plurality of photosensitive drums, and a plurality of developing device. The casing includes a first frame and a second frame. The plurality of photosensitive drums is configured to rotate about an axis line extending in an axial direction and juxtaposed at intervals in the casing. The casing defines one side and the other side in the axial direction. Drive force for rotating the plurality of photosensitive drums is inputted to the one side of the plurality of photosensitive drums. The plurality of developing device is provided to correspond to the plurality of photosensitive drums and configured to supply developing agent to the corresponding photosensitive drum. The first frame is made of metal and is configured to support the one side of each of the plurality of photosensitive drums, and the second frame is made of resin and is configured to support the other side of each of the plurality of photosensitive drums.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of a Printer

Figure 1:
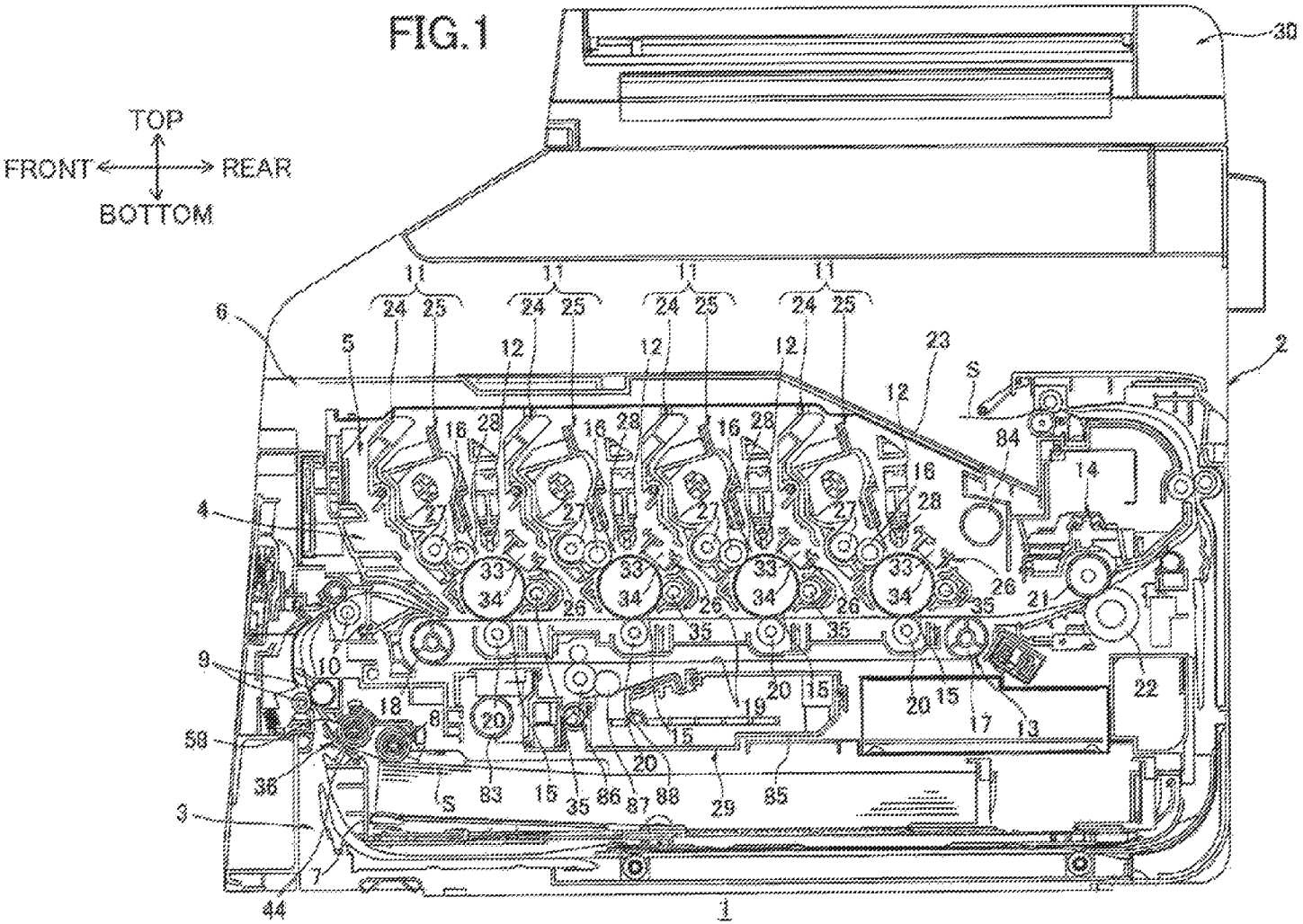
FIG. 1 is a central cross-sectional view of a printer according to an embodiment of the invention.

FIG. 1 shows a printer 1 according to the present invention. The printer 1 is a direct horizontal tandem-type color printer.

The printer 1 is a multifunction peripheral integrally provided with a main casing 2, and a flatbed scanner 30 provided above the main casing 2 for reading image data from a document.

Directions used in the following description in relation to the printer 1 will reference the state of the printer 1 when the printer 1 is rested on a level surface, where the upper side of the printer 1 in FIG. 1 will be called the "upper side" and the lower side in FIG. 1 the "lower side." Further, the left side of the printer in FIG. 1 will be called the "front" and the right side the "rear." Left and right sides of the printer 1 will be defined based on the perspective of the user facing the front of the printer 1. Thus, the far side of the printer 1 in FIG. 1 will be considered the "left side" and the near side the "right side."

Within the main casing 2, the printer 1 also includes a sheet-feeding unit 3 for feeding sheets S of a paper to be printed, and an image-forming unit 4 for forming images on the sheets S supplied by the sheet-feeding unit 3.

(1) Main Casing

The main casing 2 is formed in a box-like shape that is generally rectangular in a side view. The main casing 2 accommodates the sheet-feeding unit 3 and the image-forming unit 4. The main casing 2 has an upper portion formed with an access opening 5 to allow for the mounting and removal of process cartridges 11 described later. The access opening 5 is open and closed by a top cover 6. The top cover 6 is pivotally movable about the rear edge thereof between a closed position in which the top cover 6 covers the access opening 5 (i.e., the state in FIG. 1), and an open position in which the access opening 5 is opened.

(2) Sheet-Feeding Unit

The sheet-feeding unit 3 includes a paper fray 7, and a feeding mechanism 36.

The paper tray 7 removably mounted in the bottom section of the main casing 2 and functions to accommodate sheets S. The paper tray 7 is provided with a separating pad 44.

The feeding mechanism 36 is disposed above the front end of the paper tray 7. The feeding mechanism 36 includes a pickup roller 8, a separating roller 58, a pair of feeding rollers 9, and a pair of registration rollers 10.

The pickup roller 8 rotates to pick up sheets S accommodated in the paper tray 7 and to convey the sheets S out of the paper tray 7. Friction produced between, the separating pad 44 and the separating roller 58 separate the sheets S one-by-one. The feeding rollers 9 rotate to feed the separated sheets S one sheet at a time toward the registration rollers 10. The registration rollers 10 rotate to convey the sheet S at a prescribed timing toward the image-forming unit 4 so that each sheet S passes between photosensitive drums 15 and a conveying belt 19 described later.

(3) Images-Forming Unit

The image-forming unit 4 includes four process cartridges 11 corresponding to the colors yellow, magenta, cyan, and black employed by the printer 1; four corresponding LED (light-emitting diode) units 12; a transfer unit 13; and a fixing unit 14.

(3-1) Process Cartridges

The four process cartridges 11 are provided above the paper tray 7 and are arranged parallel to one another and spaced at intervals in the front-rear direction. Each of the process cartridges 11 is detachably mounted in the main casing 2 and includes a drum cartridge 24, and a developer cartridge 25.

The drum cartridge 24 is detachably mounted in the main casing 2 and includes a photosensitive drum 15, a scorotron charger 26, and a cleaning roller 35.

The photosensitive drum 15 has a cylindrical shape and is oriented with their axes aligned in the left-right direction. Each of the photosensitive drum 15 is rotatably supported in the corresponding drum cartridge 24. That is, four of the photosensitive drums 15 are provided to correspond to the four process cartridges 11. The photosensitive drums 15 are arranged parallel to one another in the main casing 2 and spaced at intervals in the front-rear direction. The photosensitive drums 15 are also detachably mounted in the main casing 2 since they are supported in the drum cartridges 24, which are detachably mounted in the main casing 2.

The scorotron chargers 26 are provided obliquely above and rearward of the corresponding photosensitive drums 15 with a space therebetween. Each scorotron charger 26 includes a charging wire 33, and a grid 34.

The charging wire 33 is stretched taut and oriented in the left-right direction. The charging wire 33 confronts but is separated from the upper rear surface of the photosensitive drum 15.

The grid 34 has a generally square U-shape that opens on the diagonally upper rear side and is positioned so as to surround the corresponding charging wire 33 from the diagonally lower front side thereof.

Four cleaning rollers 35 are provided to correspond to the four photosensitive drums 15. Each cleaning roller 35 is disposed immediately below the corresponding scorotron charger 26 so as to contact the rear side of the corresponding photosensitive drum 15.

The developer cartridges 25 are detachably mounted in the corresponding drum cartridges 24. Four developer cartridges 25 are provided to correspond to the four photosensitive drums 15. Each developer cartridge 25 has a developing roller 16.

The developing roller 16 is provided in the lower portion of the developer cartridge 25 so as to be exposed outside the developer cartridge 25 through the diagonally lower rear side thereof. The developing roller 16 contacts the photosensitive drum 15 on the diagonally upper front side.

Each developer cartridge 25 also includes a supply roller 27 for supplying toner to the developing roller 16, and a thickness-regulating blade 28 for regulating the thickness of toner carried on the developing roller 16. The upper section of the developer cartridge 25 serves to accommodate toner.

(3-2) LED Units

Four of the LED units 12 are provided to correspond to the four photosensitive drums 15. Each LED unit 12 is disposed so as to be in confrontation with the top of the corresponding photosensitive drum 15.

(3-3) Transfer Unit

The transfer unit 13 is disposed above the paper tray 7 and below the process cartridges 11 and is oriented in the front-rear direction. The transfer unit 13 includes a drive roller 17, a follow roller 18, a conveying belt 19, four transfer rollers 20, and a belt-cleaning unit 29.

The drive roller 17 and the follow roller 18 are arranged parallel to each other and are spaced apart in the front-rear direction.

The conveying belt 19 is looped around the drive roller 17 and the follow roller 18 and has an upper portion facing and contacting the bottom surfaces of the photosensitive drums 15.

When the drive roller 17 is driven to rotate, the conveying belt 19 circulates so that the upper portion of the conveying belt 19 in contact with the photosensitive drums 15 moves rearward.

Four of the transfer rollers 20 are provided to correspond to the four photosensitive drums 15. Each of the transfer rollers 20 confronts the corresponding photosensitive drum 15 with the upper portion of the conveying belt 19 interposed therebetween.

The belt-cleaning unit 29 is disposed beneath the conveying belt 19. The belt-cleaning unit 29 includes a waste toner box 85 that is substantially rectangular in a side view, a belt-cleaning roller 86 disposed in the upper end of the waste toner box 85, a scraping roller 87, and a scraping blade 88. During an image-forming operation described later, paper dust, waste toner, and other matter deposited on the surface of the conveying belt 19 is removed from the conveying belt 19 by the belt-cleaning roller 86 and retained temporarily on the scraping roller 87. Subsequently, the scraping blade 88 scrapes off this matter from the scraping roller 87, and then, the matter is collected in the waste toner box 85.

(3-4) Fixing Unit

The fixing unit 14 is disposed on the rear side of the transfer unit 13. The fixing unit 14 includes a heating roller 21, and a pressure roller 22 that contacts the heating roller 21 with pressure.

(4) Image-Forming Operation

Toner in each of the developer cartridges 25 is supplied onto the corresponding supply roller 27, which in turn supplies toner to the developing roller 16. The toner is positively tribocharged between the supply roller 27 and the developing roller 16. The thickness-regulating blade 28 regulates the thickness of toner supplied to the developing roller 16 as the developing roller 16 rotates, maintaining the layer of toner carried on the surface of the developing roller 16 at a thin uniform thickness.

In the meantime, the scorotron charger 26 applies a uniform charge to the surface of the photosensitive drum 15 as the photosensitive drum 15 rotates, and the LED unit 12 subsequently irradiates light on the surface of the photosensitive drum 15 based on prescribed image data, forming an electrostatic latent image on the surface of the photosensitive drum 15. Next, the toner carried on the surface of the developing roller 16 is supplied to the electrostatic latent image formed on the surface of the photosensitive drum 15, developing the latent image into a toner image. Thus, each developer cartridge 25 supplies toner to the corresponding photosensitive drum 15.

At the same time, a sheet S supplied from the sheet-feeding unit 3 onto the conveying belt 19 is conveyed rearward by the conveying belt 19. The toner images of all four colors are sequentially superimposed onto the sheet S as the sheet S passes between each photosensitive drum 15 and its corresponding transfer roller 20, thereby forming a color image on the sheet S.

The toner images transferred from the photosensitive drums 15 to the sheet S are subsequently fixed to the sheet S by heat and pressure as the sheet S passes between the heating roller 21 and the pressure roller 22. Through this process, the color image transferred onto the sheet S is thermally fixed to the sheet S.

Thereafter, the sheet S is conveyed along a U-shaped path that curves upward and forward and is discharged onto a discharge tray 23 provided on the top cover 6.

2. Process Cartridges (1) Drum Cartridges

Figure 2:
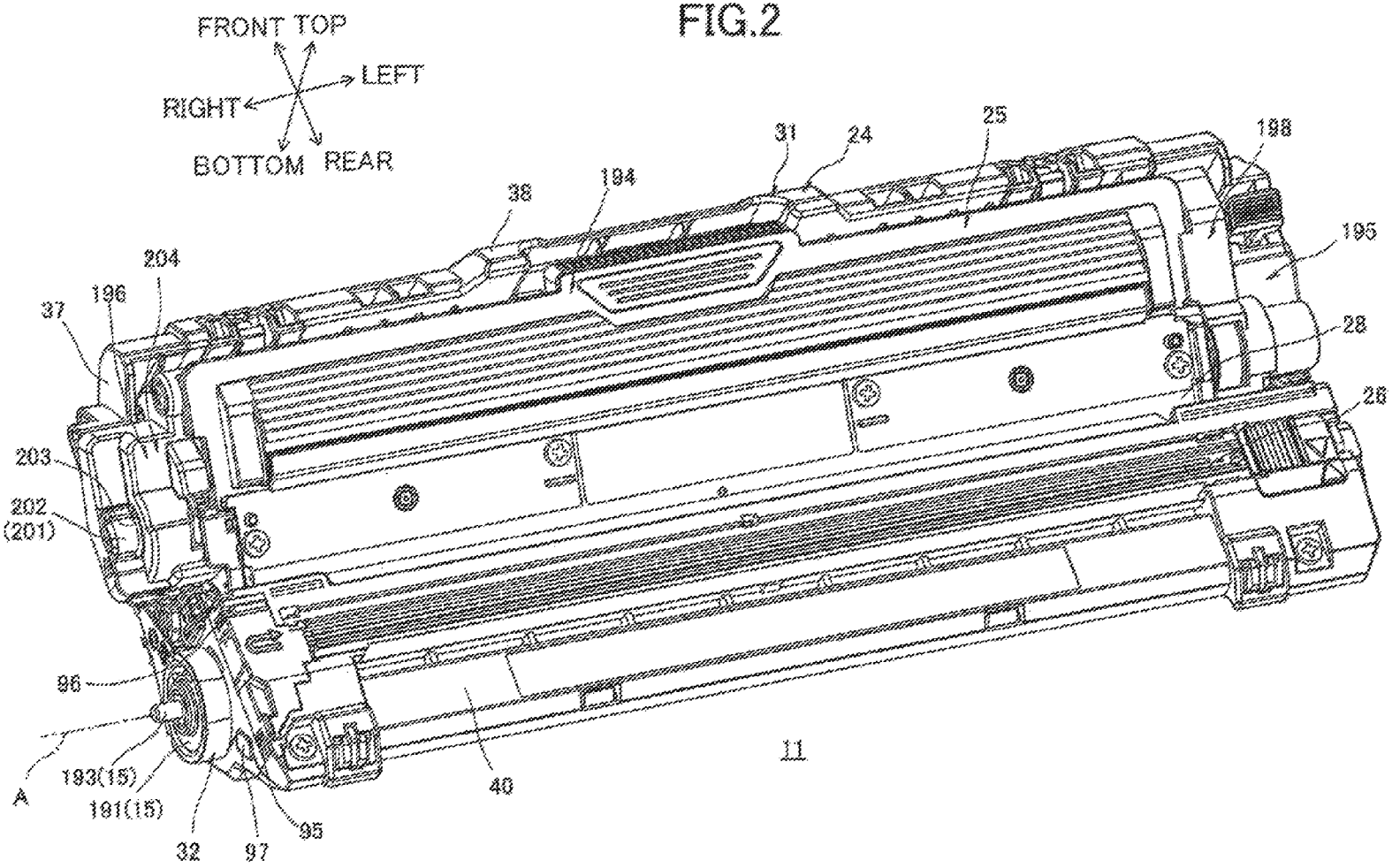
FIG. 2 is a perspective view of a process cartridge of the printer as viewed from diagonally backward-right.

As shown in FIGS. 2 and 3, each drum cartridge 24 has a drum-cartridge frame 31, the photosensitive drum 15, and bearing members 32.

Directions with respect to the process cartridge 11 in the following description will be given under the assumption that the process cartridge 11 is resting on a level surface, and more specifically will be based on the directional arrows shown in the drawings.

(1-1) Drum-Cartridge Frame

As shown in FIG. 2, the drum-cartridge frame 31 has a frame-like shape with a closed bottom and is generally rectangular in a plan view. The drum-cartridge frame 31 is configured of a pair of left and right side walls 37, a front wall 38, a bottom wall 39, and a top wall 40.

The side walls 37 are arranged parallel to each other and spaced apart in the left-right direction. As shown in FIG. 3, the side walls 37 are generally rectangular in a side view and extend in vertical and front-rear directions. Each side wall 37 is formed with a flange insertion hole 65 and an exposing groove 74.

The flange insertion hole 65 has a general circular shape in a side view. The flange insertion hole 65 is formed in the rear end of the side wall 37 and penetrates the side wall 37 in the left-right direction.

The exposing groove 74 is formed in the approximate front-rear center of the side wall 37. The exposing groove 74 has a general) V-shape in a side view and opens on the top as if the exposing groove 74 was cut out from the upper edge of the side wall 37.

Figure 3A:
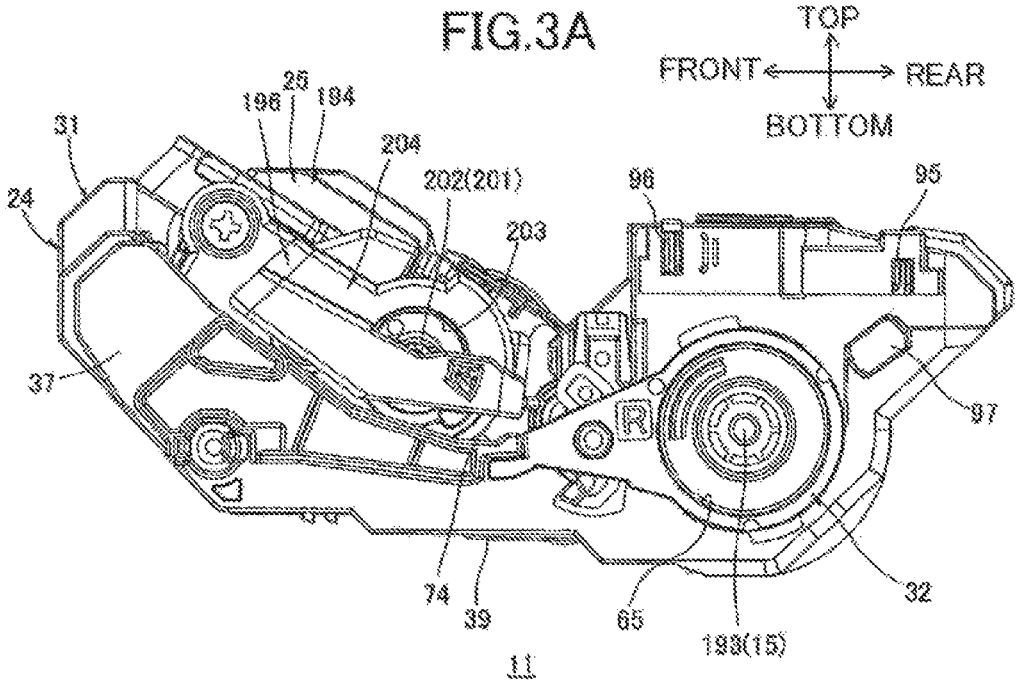
FIG. 3A is a right-side view of the process cartridge shown in FIG. 2.

As shown in FIG. 3A, the right side wall 37 supports a cartridge-side grid electrode 95, a cartridge-side wire electrode 96, and a cartridge-side cleaner electrode 97.

The cartridge-side grid electrode 95 is disposed on the rear end of the side wall 37 near the upper edge thereof. The cartridge-side grid electrode 95 is generally rectilinear and oriented vertically. The cartridge-side grid electrode 95 is electrically connected to the grid 34 shown in FIG. 1.

The cartridge-side wire electrode 96 is disposed on the rear end of the side wall 37 to the rear of the cartridge-side grid electrode 95 and is separated from the cartridge-side grid electrode 95. The cartridge-side wire electrode 96 is also generally rectilinear and oriented vertically. The cartridge-side wire electrode 96 is electrically connected to the charging wire 33 shown in FIG. 1.

The cartridge-side cleaner electrode 97 is disposed on the side wall 37 beneath the cartridge-side grid electrode 95 and is separated from the cartridge-side grid electrode 95. The cartridge-side cleaner electrode 97 is formed of an electrically conductive resin material and is generally rectangular in a side view.

As shown in FIG. 2, the front wall 38 has a generally flat plate shape that expands in vertical and left-right directions. The front wall 38 bridges the front ends of the side walls 37.

Figure 3B:
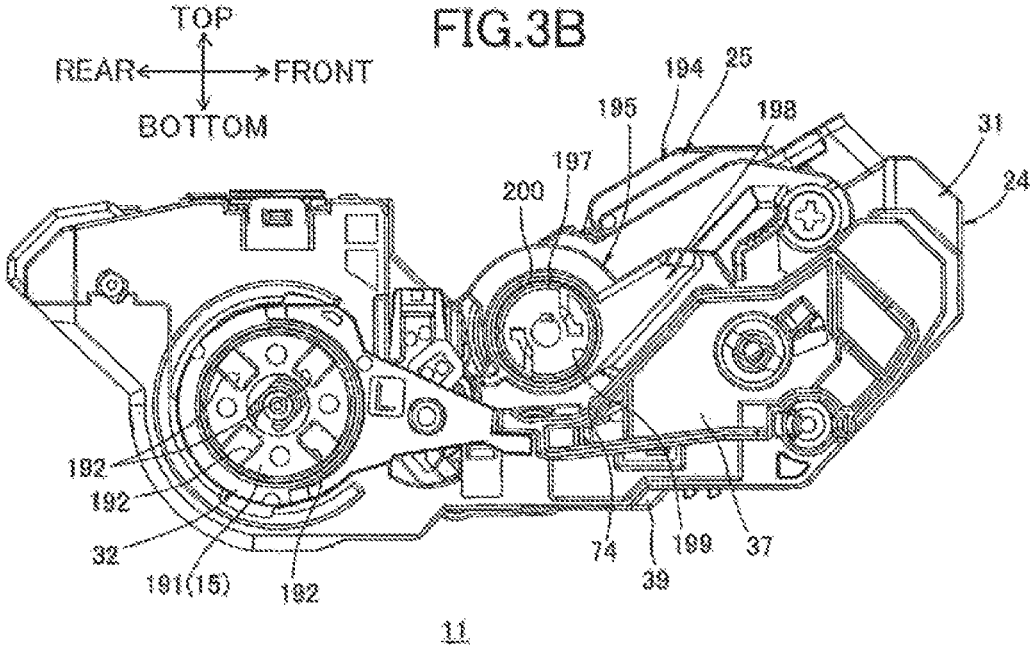
FIG. 3B is a left-side view of the process cartridge shown in FIG. 2.

As shown in FIGS. 3A and 3B, the bottom wall 39 has a generally flat plate shape that is elongated in front-rear and left-right directions. The bottom wall 39 bridges the lower edges of the side walls 37. The front edge of the bottom wall 39 is formed continuously from the bottom edge of the front wall 38.

As shown in FIG. 2, the top wall 40 has a generally flat plate shape that expands in the front-rear and left-right directions. The top wall 40 bridges the upper edges of the side walls 37 at the rear ends thereof so as to cover the top of the photosensitive drum 15. The scorotron charger 26 is embedded in the top wall 40.

(1-2) Photosensitive Drums

Figure 22:
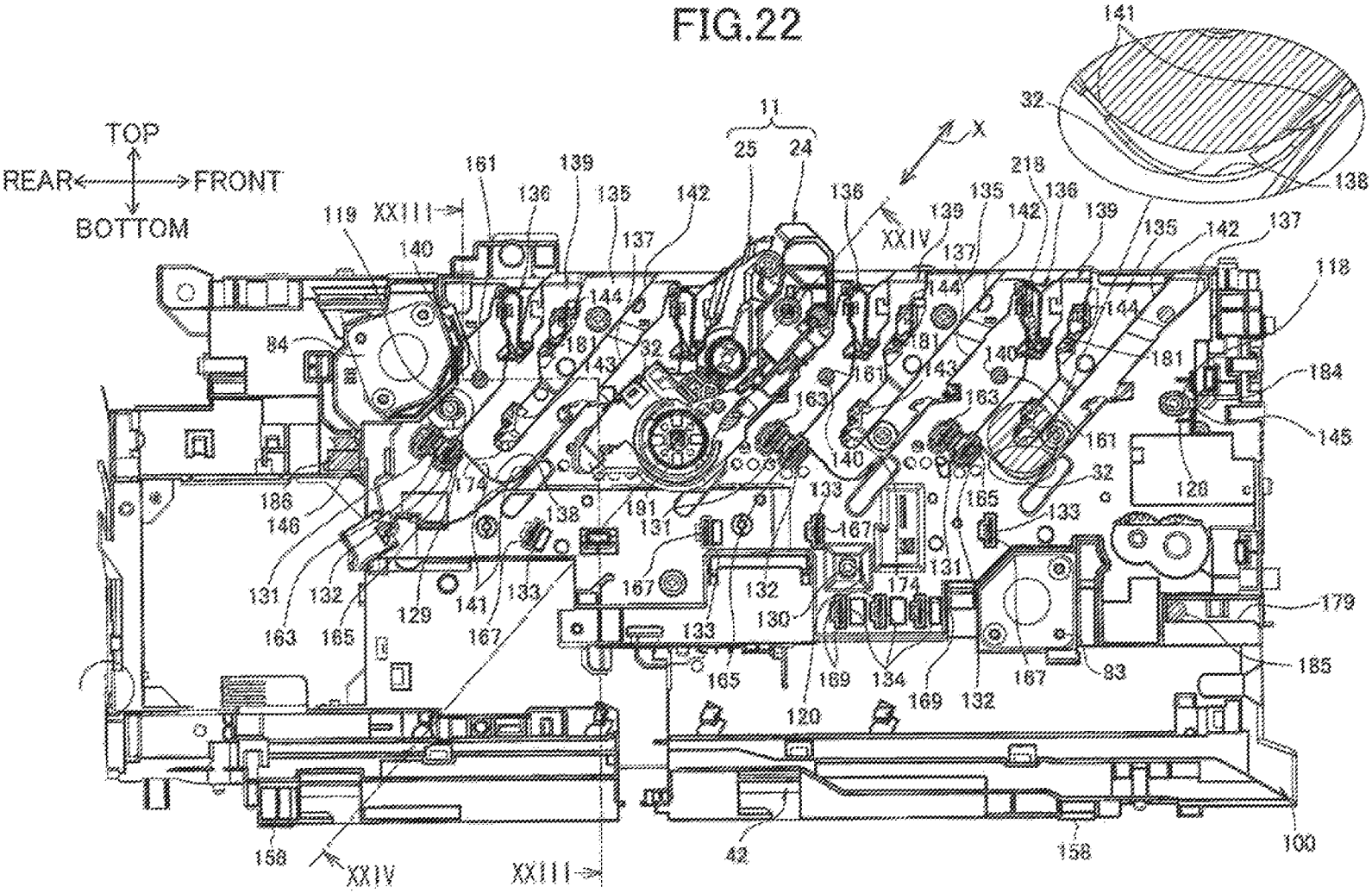
FIG. 22 is a left side view of the right wall shown in FIG. 15 with the process cartridge mounted.
Figure 24:
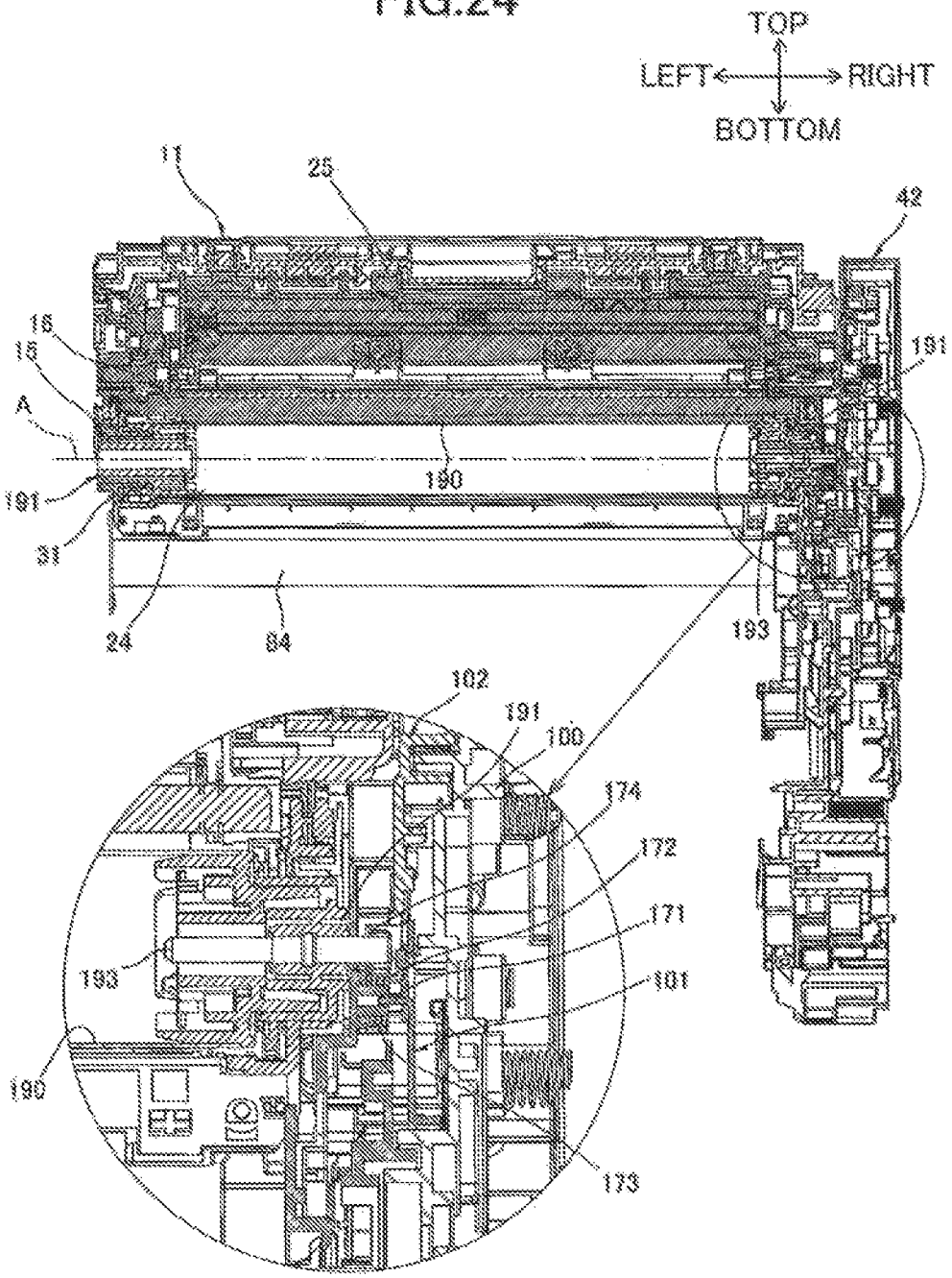
FIG. 24 is across-sectional view taken along a line XXIV-XXIV in FIG. 22.

As shown in FIGS. 22 and 24, each photosensitive drum 15 includes a drum body 190, and a pair of left and right flange members 191.

The drum body 190 is formed of metal in a generally cylindrical shape and is oriented with its axis in the left-right direction. The outer surface of the drum body 190 is coated with a layer of a photosensitive resin.

The left flange member 191 has a general columnar shape elongated in the left-right direction. This left flange member 191 is fitted into the left end of the drum body 190 so as to be incapable of rotating relative to the drum body 190. As shown in FIG. 3B, a plurality of coupling parts 192 is formed in the left surface of the left flange member 191.

More specifically, tour of the coupling parts 192 are formed in the left surfaces of the left flange members 191 around the outer circumference thereof at intervals of 90 degrees in the circumferential direction. The coupling parts 192 are formed as recesses in the left surfaces of the flange members 191 and are generally rectangular in a side view.

A drum-body coupling 71 described later (FIG. 8) is inserted into the coupling parts 192 when the process cartridge 11 is mounted in the main casing 2. A rotational drive force is inputted into the coupling parts 192 via the drum-body coupling 71 from a motor 70 described later.

As shown in FIGS. 22 and 24, the right flange member 191 has a general columnar shape and extends in the left-right direction. The flange member 191 is fitted into the right end of the drum body 190 so as to be incapable of rotating relative thereto. The right flange member 191 supports a shaft 193.

As shown in FIG. 3A, the shall 193 has a general columnar shape and is oriented in the left-right direction. The shaft 193 passes through the radial center of the right flange member 191 in the left-right direction. As shown in FIG. 24, the right end of the shaft 193 protrudes rightward from the right surface of the right flange member 191.

The photosensitive drum 15 is disposed in the rear end of the drum-cartridge frame 31 with the left and right flange members 191 inserted into the flange insertion holes 65 of the corresponding side walls 37. In this state, the left and right flange members 191 pass through the flange insertion holes 65 respectively and protrude outward in corresponding left and right directions from the side walls 37.

(1-3) Bearing Members

As shown in FIGS. 2 and 3, one bearing member 32 is supported in the rear end of each side wall 37. The bearing members 32 have a general cylindrical shape extending in the left-right direction. The inner diameter of the bearing members 32 is approximately equal to the outer diameter of the flange members 191. The bearing members 32 are supported in the side walls 37 of the drum-cartridge frame 31 and are fitted around the outer peripheries of the corresponding flange members 191 so as to be rotatable relative thereto. Hence, the photosensitive drum 15 is supported in the drum-cartridge frame 31 through the bearing members 32, as illustrated in FIG. 2, When a drive force is inputted into the coupling parts 192, the photosensitive drum 15 rotates about an axis A.

(2) Developer Cartridges

As shown in FIG. 2, each developer cartridge 25 has a developer-cartridge frame 194, a drive unit 195, and a power-supply unit 196.

The developer-cartridge frame 194 has a box-like shape and is elongated in the left-right direction. The developer-cartridge frame 194 supports the corresponding developing roller 16, the supply roller 27, and the thickness-regulating blade 28 and has interior space for accommodating toner.

The drive unit 195 is provided on the left side of the developer-cartridge frame 194. As shown in FIG. 3B, the drive unit 195 includes a development coupling 197, and a drive-side cover 198.

The development coupling 197 has a general columnar shape extending in the left-right direction. The development coupling 197 is rotatably supported in the left wall of the developer-cartridge frame 194. The development coupling 197 has the left endface formed with a coupling recession 199.

The coupling recession 199 is recessed from the left endface of the development coupling 197. When the developer cartridge 25 is mounted in the main casing 2, the distal end of a body-side development coupling 72 described later (FIG. 8) is inserted into the corresponding coupling recession 199 so as to be incapable of rotating relative to the development coupling 197. The motor 70 inputs a rotational drive force into the development coupling 197 via the body-side development coupling 72. The rotation drive force inputted into the development coupling 197 is then transmitted to the developing roller 16 and the supply roller 27 via a gear train (not shown).

The drive-side cover 198 has a generally square tube shape elongated in the left-right direction with the left end closed.

A coupling-recession exposing hole 200 is formed in in approximately the front-rear center thereof. The coupling-recession exposing hole 200 is circular in a side view and penetrates the drive-side cover 198.

The drive-side cover 198 is fixed to the left wall of the developer-cartridge frame 194 with screws such that the coupling recession 199 in the development coupling 197 is exposed through the coupling-recession exposing hole 200.

As shown in FIG. 2, the power-supply unit 196 is disposed on the right side of the developer-cartridge frame 194. The power-supply unit 196 includes a development electrode member 201, and a supply-side cover 204.

The development electrode member 201 is formed of an electrically conductive resin material, such as a conductive polyacetal resin. The development electrode member 201 is supported on the right wall of the developer-cartridge frame 194 inside the supply-side cover 204. The development electrode member 201 includes a power-receiving part 202.

The power-receiving part 202 has a general cylindrical shape extending in the left-right direction.

The development electrode member 201 is further provided with a developing-roller-shaft support part and a supply-roller-shaft support part, both not shown in the drawings. The developing-roller-shaft support part rotatably supports the metal rotational shaft of the developing roller 16 on the rear side of the power-receiving part 202. The supply-roller-shaft support part rotatably supports the metal rotational shaft of the supply roller 27 diagonally below and rearward of the power-receiving part 202.

The supply-side cover 204 has a generally square cylindrical shape extending in the left-right direction with the right end closed. The supply-side cover 204 is formed with a power-receiving-part exposing hole 203.

The power-receiving-part exposing hole 203 is generally rectangular in a plan view and penetrates the top wall of the supply-side cover 204 on the right end thereof for exposing the right end of the power-receiving part 202.

The supply-side cover 204 is fixed with screws to the right wall of the developer-cartridge frame 194 such that the right end of the power-receiving part 202 is exposed through the power-receiving-part exposing hole 203.

3. Main Casing

Figure 4:
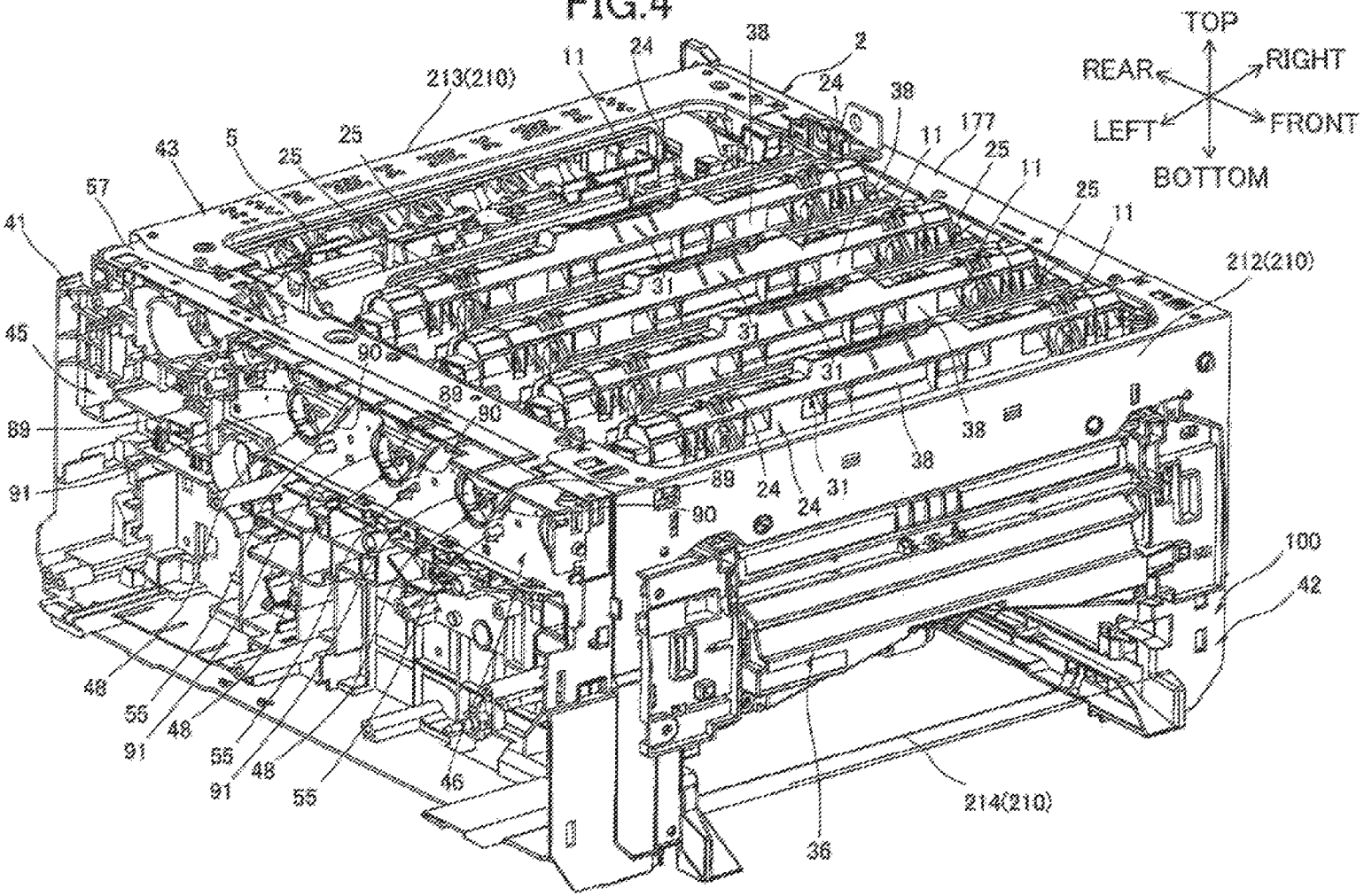
FIG. 4 is a perspective view of a main casing of the printer with the process cartridges mounted as viewed from diagonally forward-left.
Figure 5:
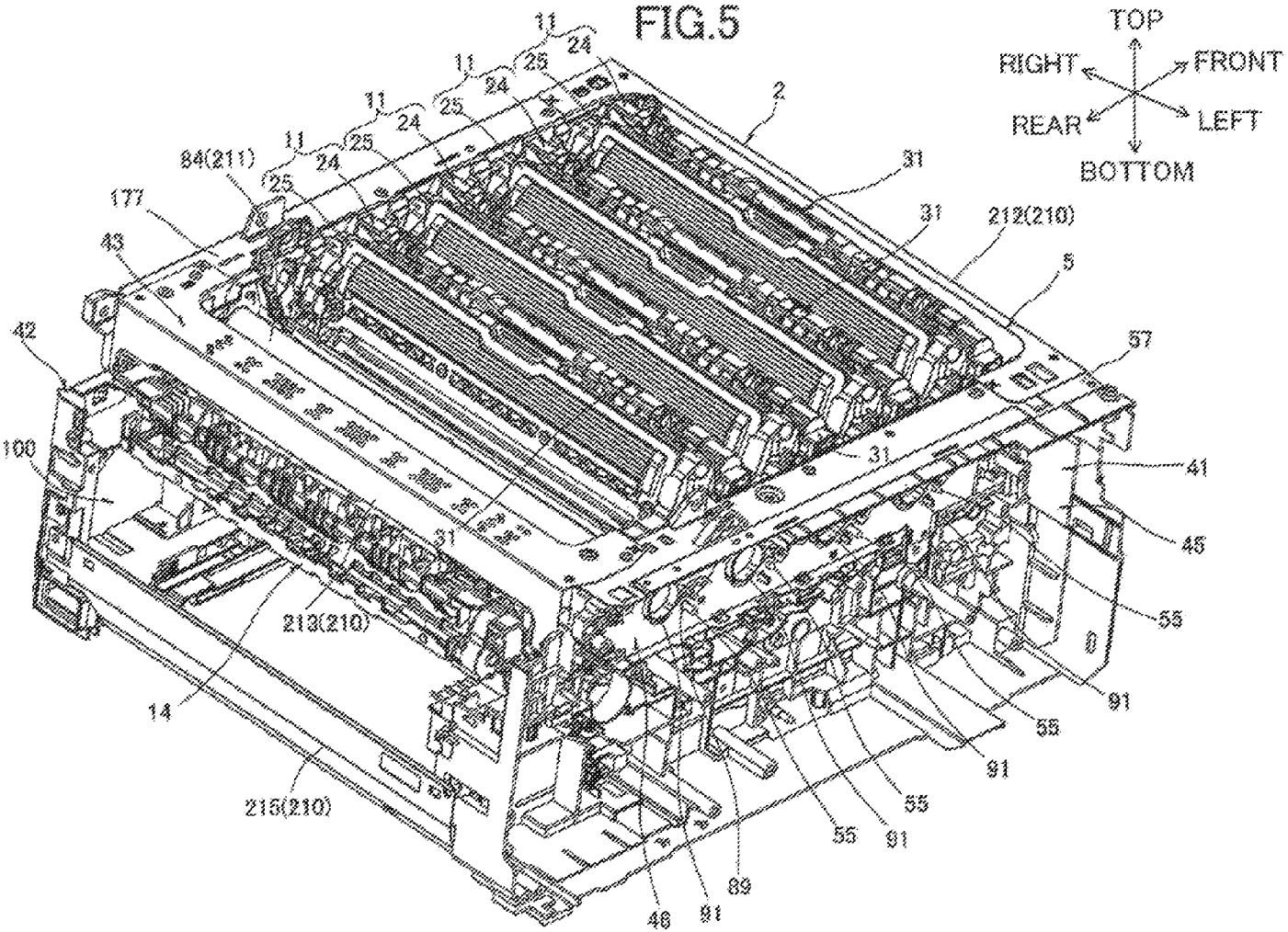
FIG. 5 is a perspective view of the main casing with the process cartridges mounted as viewed from diagonally backward-left.
Figure 8:
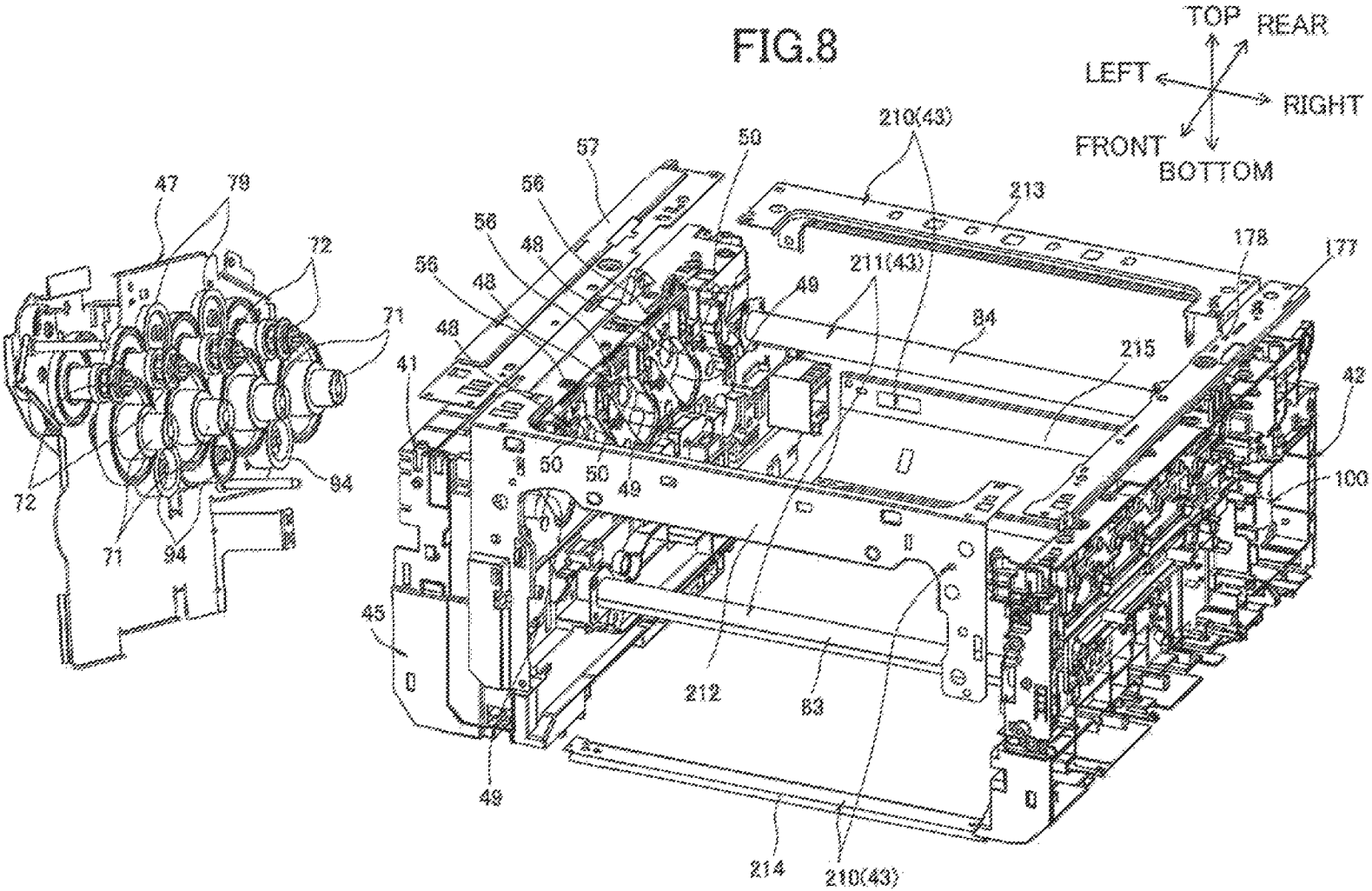
FIG. 8 is an exploded perspective view of the main casing without the process cartridges as viewed from diagonally forward-right.

As shown in FIGS. 4, 5, and 8, the main casing 2 includes a left wall 41 and a right wall 42 arranged parallel to each other and spaced apart in the left-right direction; and a reinforcing unit 43 spanning between the left wall 41 and the right wall 42.

(1) Left Wall

Figure 9:
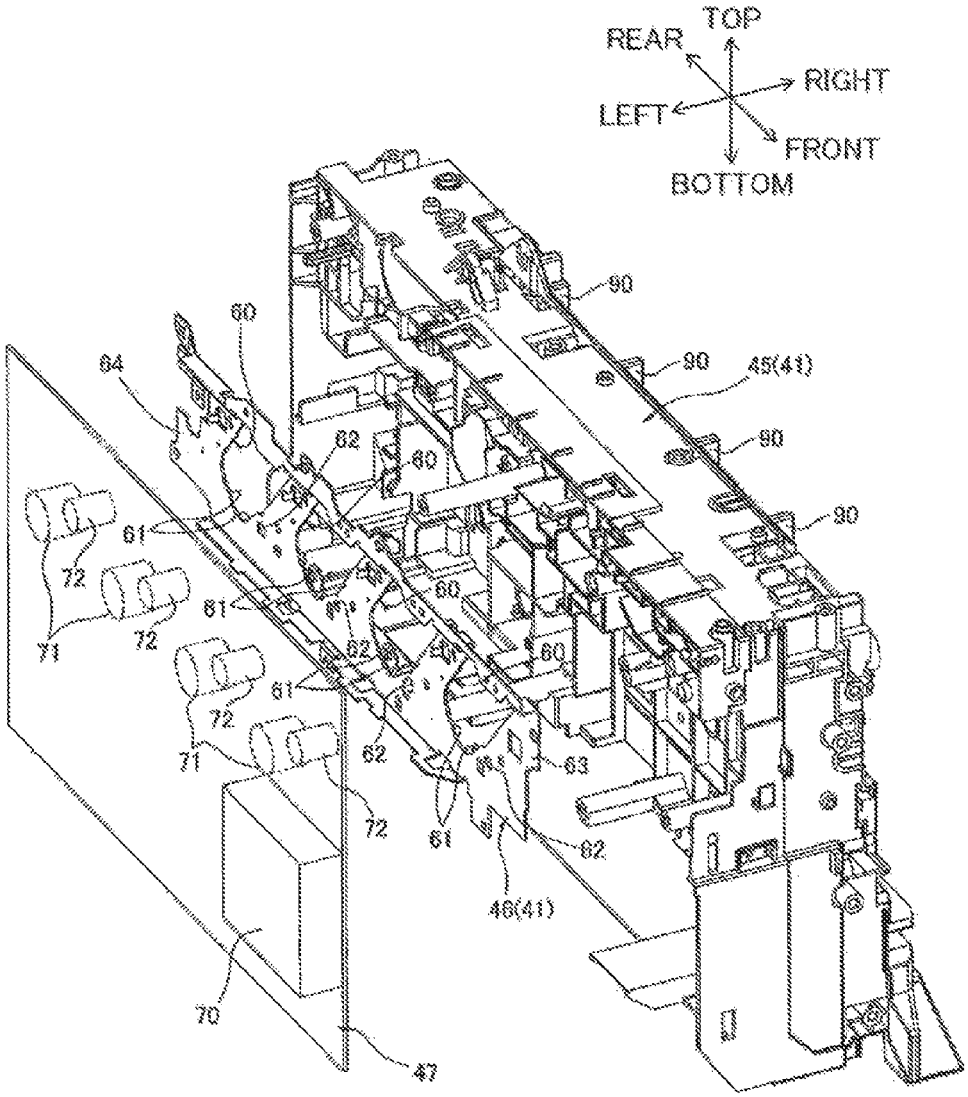
FIG. 9 is an exploded perspective view of a left wall of the main casing as viewed from diagonally forward-left.

As shown in FIG. 9, the left wall 41 includes a first resin frame 45, and a metal frame 46.

(1-1) First Resin Frame

Figure 11:
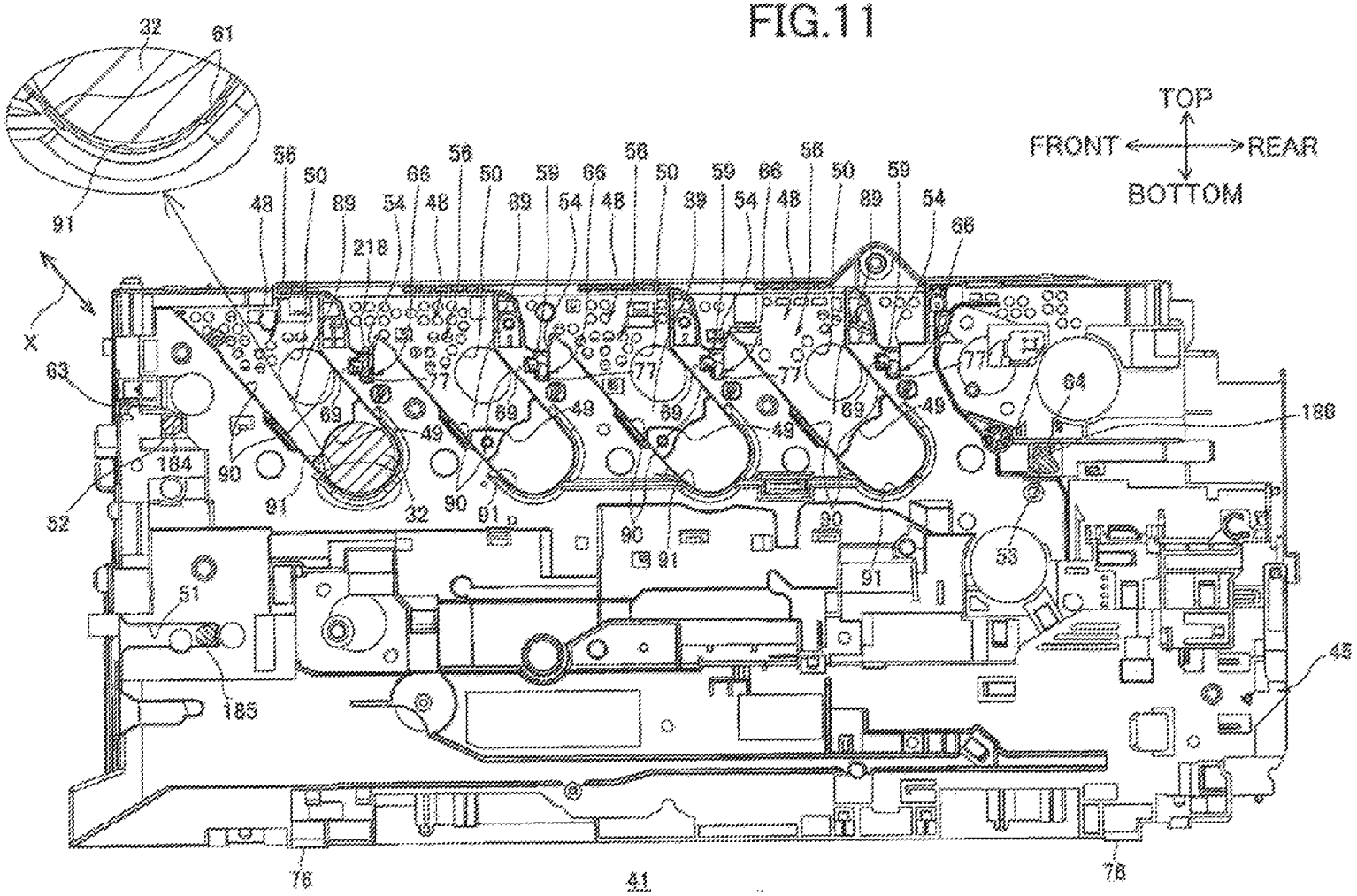
FIG. 11 is a right side view of the left wall of the main casing.

As shown in FIG. 11, the first resin frame 45 has a generally flat plate shape that is substantially rectangular in a side view and elongated in the front-rear direction. The first resin frame 45 is formed of polystyrene or another resin material. The first resin frame 45 includes first drum guide parts 48, first LED grooves 54, a first sheet-feed boss hole 52, a first sheet-feed boss groove 51, and a first fixing-unit boss hole 53.

Four of the first drum guide parts 48 are formed in the right surface of the first resin frame 45. The first drum guide parts 48 are positioned in the upper portion of the first resin frame 45 and are spaced at intervals in the front-rear direction. The first drum guide parts 48 are provided to correspond with the four process cartridges 11 shown in FIG. 1.

Figure 7:
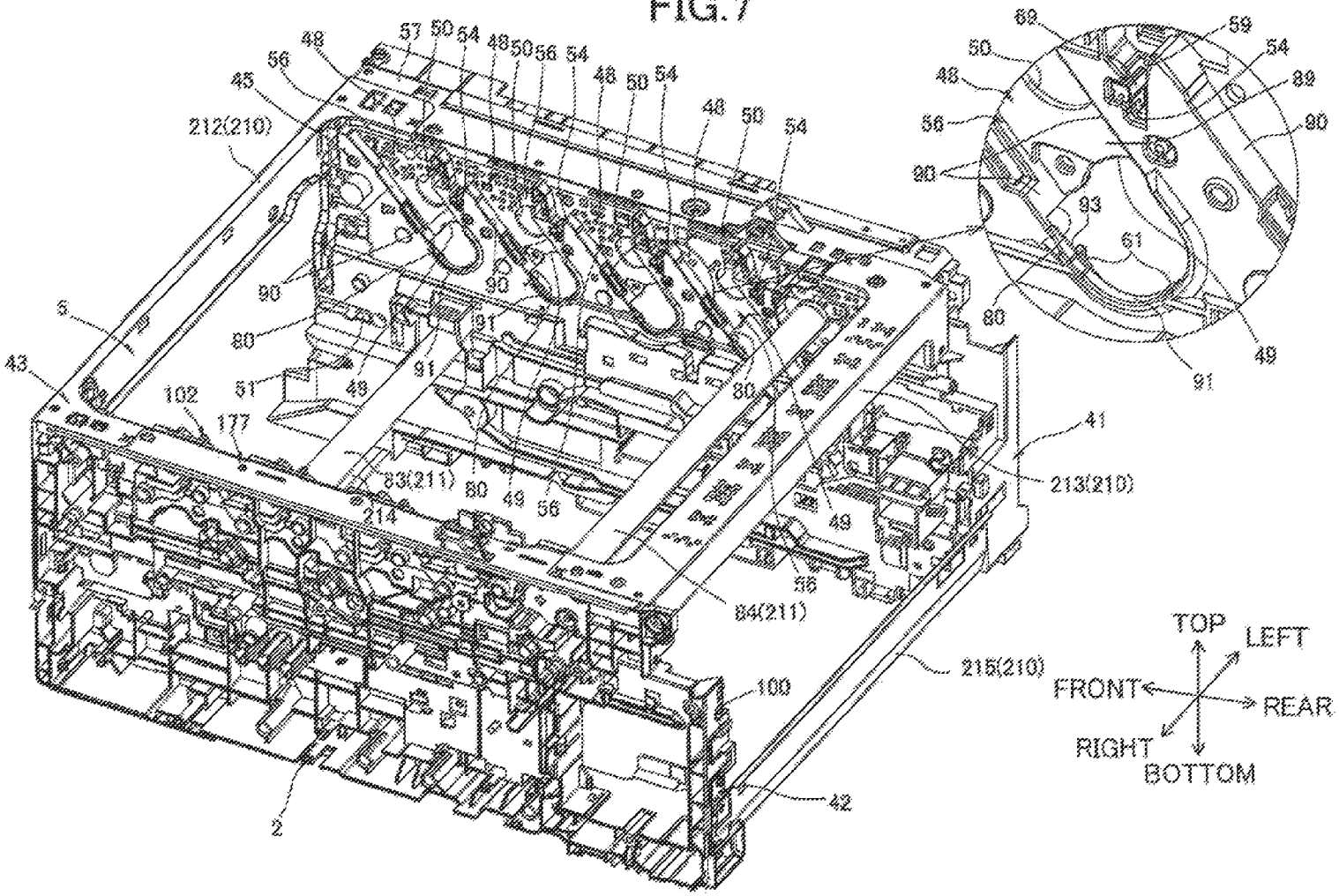
FIG. 7 is a perspective view of the main casing without the process cartridges viewed from diagonally backward-right.

Each first drum guide part 48 is formed in the top edge of the first resin frame 45 and is recessed diagonally downward and rearward. The first drum guide parts 48 are generally U-shaped in a side view. The first drum guide parts 48 are recessed leftward from the right surface of the first resin frame 45, as shown in FIG. 7, and expand leftward from the left surface of the first resin frame 45, as shown in FIG. 4.

As shown in FIG. 11, each, first drum guide part 48 is integrally configured of a pair of front and rear first rail parts 90, a first carved part 91, and a first enclosing part 89.

Each of the first rail parts 90 is shaped to appear bent leftward from the right surface of the first resin frame 45. The first rail parts 90 extend in a direction sloping diagonally downward and rearward from the top edge of the first resin frame 45 (i.e., in a mounting direction X described later for mounting the process cartridge 11), The first, rail parts 90 are spaced apart in the front-rear direction by a gap greater than the outer diameter of the bearing member 32.

The first curved part 91 is provided to connect the lower edges of the first rail parts 90 and is formed continuously with both lower edges. The first curved part 91 has a generally semicircular shape in a side view, with its convex side facing obliquely downward and rearward.

The first enclosing part 89 is coupled with the left edges of the corresponding first rail parts 90 and the first curved part 91.

A first guiding groove 56 is defined by the rear surface of the front first rail part 90, the front surface of the rear first rail part 90, the top surface of the first curved part 91, and the right surface of the first enclosing part 89.

Each first drum guide part 48 is formed with a drum-coupling insertion hole 49, a development-coupling insertion hole 50, and a cutout part 80 shown in FIG. 7.

The drum-coupling insertion hole 49 is formed in the lower portion of the first enclosing part 89 adjacent to the first curved part 91. The drum-coupling insertion hole 49 is generally circular in a side view and penetrates the first enclosing part 89.

The development-coupling insertion hole 50 is formed in an upper portion of the first enclosing part 89 separated from the drum-coupling insertion hole 49 in a direction diagonally above and forward. The development-coupling insertion hole 50 has a general elliptical shape in a side view and is elongated in a direction sloping downward and rearward. The development-coupling insertion hole 50 penetrates the first enclosing part 89 in the left-right direction.

As shown in FIG. 7, the cutout part 80 is formed by cutting rightward into the left portion of the first curved part 91 around the periphery of the drum-coupling insertion hole 49.

As shown in FIG. 11, four of the first LED grooves 54 are formed in the right surface of the first resin frame 45 on the upper portion thereof. The first LED grooves 54 are spaced apart in the front-rear direction and positioned to correspond to the four LED units 12.

Each first LED groove 54 is formed in a position to the rear of the corresponding first drum guide part 48 and above the corresponding drum-coupling insertion hole 49. As shown in FIG. 7, the first LED groove 54 has a generally square U-shape in a side view and is recessed both downward from the top edge of the first resin, frame 45 and leftward from the right surface of the first resin frame 45.

Figure 12:
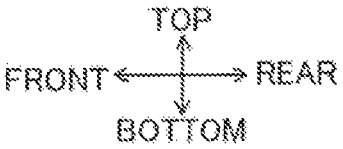
FIG. 12 is an enlarged cross-sectional view of a first LED positioning member shown in FIG. 11.
Figure 12:
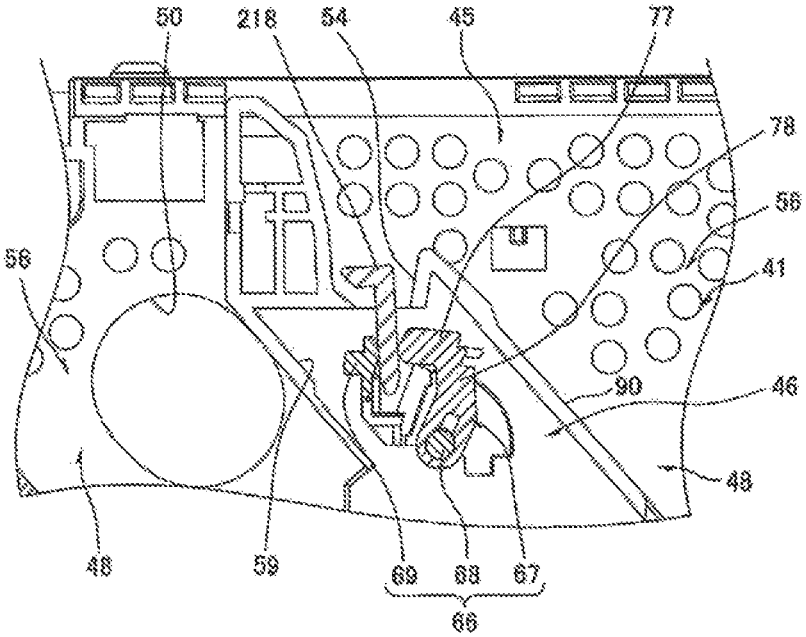

The first LED groove 54 has the left wall formed with a positioning through-hole 59 penetrating the same in the left-right direction. As shown in FIG. 12, the positioning through-hole 59 has vertical and front-rear dimensions slightly greater than the same dimensions of a first LED-positioning member 66 described later.

As shown in FIG. 11, the first sheet-feed boss hole 52 is formed at a position forward of and separated from the forwardmost first drum guide part 48. The first sheet-feed boss hole 52 is generally rectangular in a side view and penetrates the first resin frame 45 in the left-right direction. The vertical and front-rear dimensions of the first sheet-feed boss hole 52 are slightly greater than the outer diameter of a first sheet-feed boss 184 described later.

The first sheet-feed boss groove 51 is formed below the first sheet-feed boss hole 52 with a space therebetween. As shown in FIG. 7, the first sheet-feed boss groove 51 is generally U-shaped in a side view, extending rearward from the from edge of the first resin frame 45 and is recessed from the right surface of the first resin frame 45 to leftward. As shown in FIG. 11, the width (vertical dimension) of the first sheet-feed boss groove 51 is approximately equal to the outer diameter of a second sheet-feed boss 185 described later.

The first fixing-unit boss hole 53 is formed at the rear side of the rearmost first drum guide part 48 and is spaced apart therefrom. The first fixing-unit boss hole 53 is generally rectangular in a side view and penetrates the first resin frame 45 in the right-left direction. The vertical and front-rear dimensions of the first fixing-unit boss hole 53 are slightly larger than the same dimensions of a fixing boss 186 described later.

Figure 6:
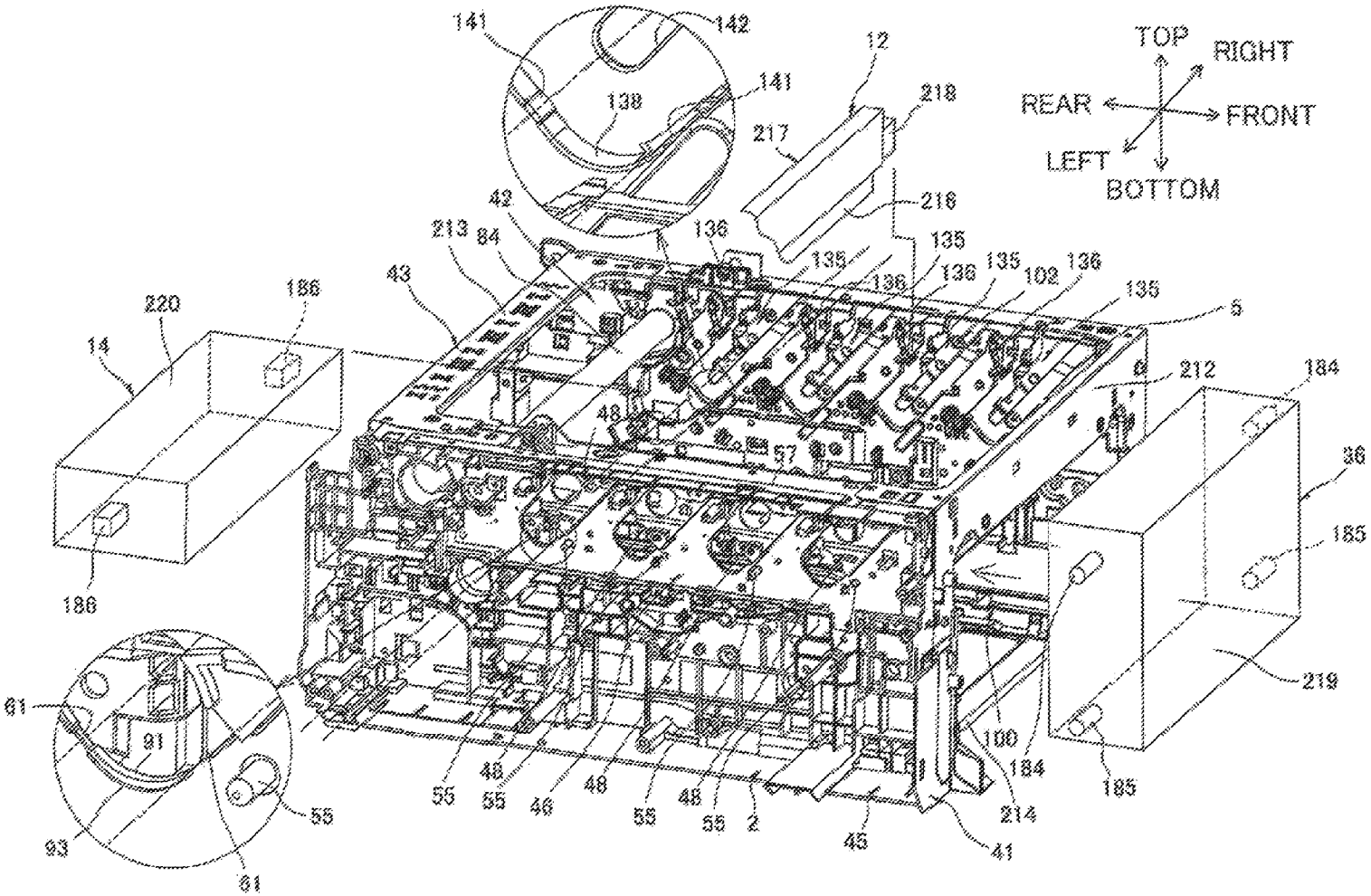
FIG. 6 is a perspective view of the main casing without the process cartridges as viewed from diagonally forward-left.
Figure 10:
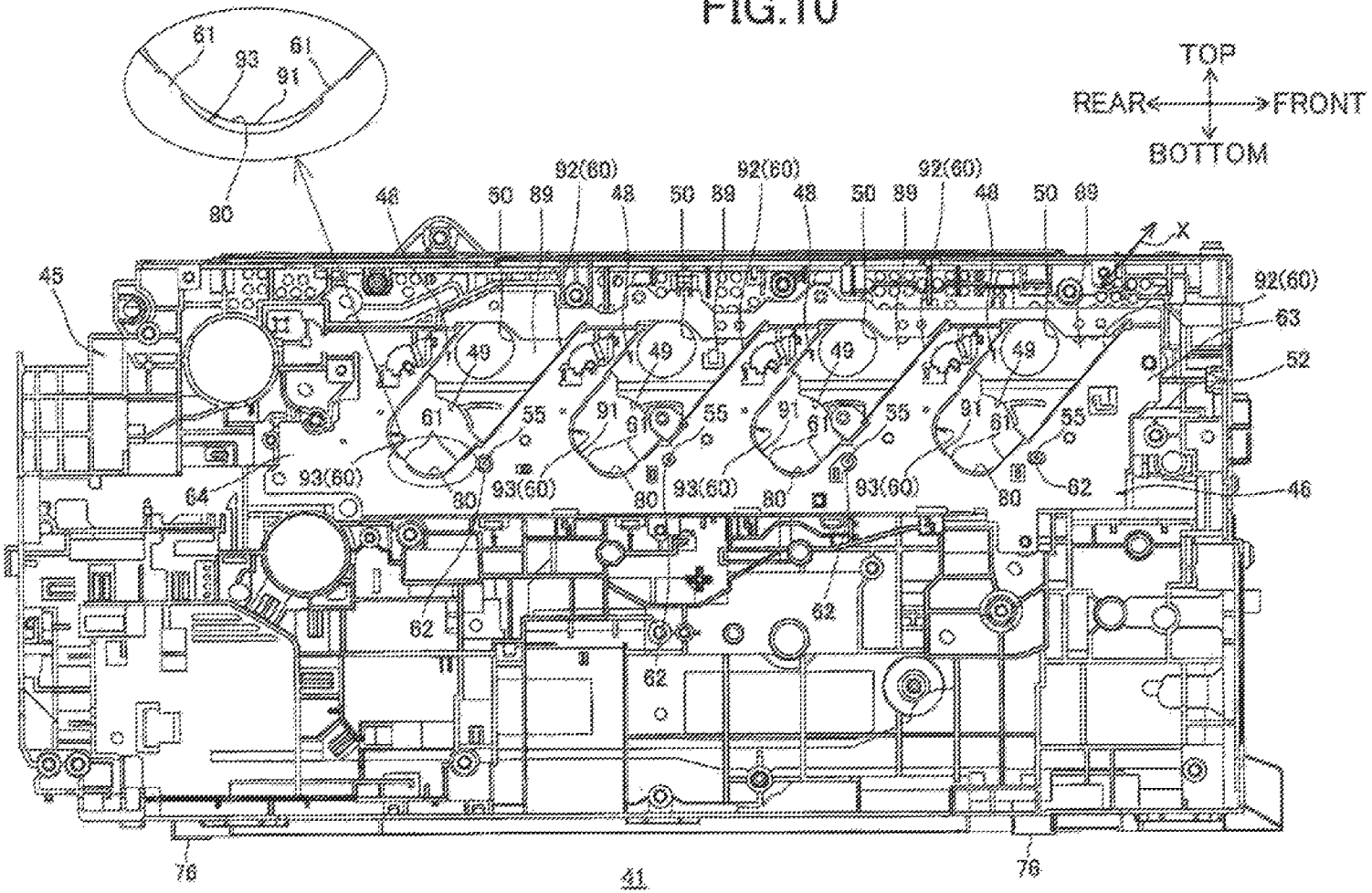
FIG. 10 a left side view of the left wall of the main casing.

As shown in FIGS. 6, 8, and 10, four positioning bosses 53 are integrally provided on the first resin frame 45, and a first reinforcing plate 57 is disposed on the first resin frame 45 as a separate member.

As shown in FIG. 5, four of the positioning bosses 55 are provided on the left surface of the first resin frame 45. The positioning bosses 55 have a general columnar shape and protrude leftward from the left surface of the first resin frame 45. As shown to FIG. 10, one positioning boss 55 is provided on the front side of each drum-coupling insertion hole 49.

As shown in FIG. 8, the first reinforcing plate 57 has a generally flat plate shape that is substantially rectangular in a plan view and elongated in the front-rear direction. The first reinforcing plate 57 is formed of metal and is fixed to the top edge of the first resin frame 45.

As shown in FIG. 10, a plurality of feet 76 are integrally provided at the bottom of the first resin frame 45 for contacting the surface on which the main casing 2 rests. In the preferred embodiment, two of the feet 76 are provided on the first resin frame 45 at positions spaced apart in the front-rear direction. The feet 76 are generally rectangular in a side view and protrude downward from the bottom edge of the first resin frame 45.

The first resin frame 45 is shaped to cover the entire image-forming unit 4 shows in FIG. 1 in a side view. The first resin frame 45 serves as a main frame member constituting the left side of the printer 1.

(1-2) Metal Frame

As shown in FIG. 10, the metal frame 46 has a generally flat plate shape that is substantially rectangular in a side view and elongated in the front-rear direction. The metal frame 46 is formed of a metal plate, such as a steel plate coated with zinc plating.

As shown in FIGS. 9 and 10, the metal frame 46 is disposed on the left side of the first resin frame 45 and is fixed to the upper portion of the left surface of the first resin frame 45. When the first resin frame 45 and the metal frame 46 are projected in the left-right direction, the entire projected surface of the metal frame 46 falls within the projected surface of the first resin frame 45. That is, the projected surface of the metal frame 46 falls within the outer peripheral edges on the projected surface of the first resin frame 45.

Frame openings 60 and a plurality of positioning holes 62 are formed in the metal frame 46.

Four of the frame openings 60 are formed at intervals in the front-rear direction so as to correspond to the four first drum guide parts 48. The frame openings 60 penetrate the metal frame 46 in the left-right direction and have a general elliptical shape in a side view, extending diagonally downward and rearward from the top edge of the metal frame 46 (i.e., in the mounting direction X described later). Each frame opening 60 has a fitting part 92 constituting its upper portion, and a support part 93 constituting its lower portion.

Each of the fitting parts 92 extends in the mounting direction X described later and forms the upper portion of the first drum guide part 48, i.e., the portion conforming in position to the corresponding pair of first rail parts 90. The front-rear dimension of the fitting part 92 is slightly larger than the gap between the first rail parts 90 in the front-rear direction.

The fitting part 92 is fitted into the upper portion of the first drum guide part 48, and specifically the upper parts of the first rail parts 90 and the first enclosing part 89.

The support part 93 is formed continuously with the bottom end of the corresponding fitting part 92. The support part 93 has a generally semicircular shape in a side view, with its convex surface facing diagonally downward and rearward. The support part 93 is formed to encompass the edge of the cutout part 80 formed in the corresponding first curved part 91 when projected in the left-right direction. Hence, the frame opening 60 is formed to encompass the edge of the corresponding first guiding groove 56 in a left-right projection.

The support part 93 is integrally provided with a pair of first positioning protrusions 61. The first positioning protrusions 61 are spaced at an interval along the circumferential direction of the support part 93. Each first positioning protrusion 61 is generally rectangular in a side view and protrudes radially inward from the peripheral edge of the support part 93.

More specifically, the rear first positioning protrusion 61 protrudes obliquely upward, and forward from the lower rear edge defining the support part 93, while the front first positioning protrusion 61 protrudes obliquely upward and rearward from the lower front edge defining the support part 93.

As shown in FIG. 7, the first positioning protrusions 61 also protrude inward from the inner peripheral surfaces of the first curved part 91 in radial directions of the first curved part 91 into the cutout part 80 formed in the first curved part 91 of the first drum guide part 48. In other words, the first positioning protrusions 61 are disposed such that their distal ends are positioned within the first guiding groove 56 when projected in a left-right direction, as illustrated in FIG. 11.

The positioning holes 62 are arranged at intervals in the front-rear direction, with one positioning hole 62 formed on the front side of the support part 93 in each frame opening 60. A total of four positioning holes 62 are provided in the preferred embodiment. The rearmost positioning hole 62 and the positioning hole 62 positioned third from the rear are generally circular in a side view and have a larger diameter than the outer diameter of the corresponding positioning bosses 55. The positioning hole 62 positioned second from the rear has a generally circular shape in a side view, with a diameter approximately equal to the outer diameter of the corresponding positioning boss 55. The forwardmost positioning hole 62 has a general elliptical shape in a side view that is elongated in the front-rear direction, with a vertical dimension approximately equal to the outer diameter of the corresponding positioning boss 55 and a front-rear dimension greater than the outer diameter of the positioning boss 55.

The positioning bosses 55 are inserted into the corresponding positioning holes 62.

As shown in FIG. 10, a first supply positioning part 63 and a first fixing-unit positioning part 64 are integrally provided on, while first LED-positioning members 66 are provided as separate members on the metal frame 46.

The first supply positioning part 63 is generally rectangular in a side view and protrudes forward from the upper portion on the front edge of the metal frame 46. The lower portion of the front edge of the first supply positioning part 63 is exposed on the right side of the first resin frame 45 through the first sheet-feed boss hole 52, as illustrated in FIG. 11.

As shown in FIG. 10, the first fixing-unit positioning part 64 is generally rectangular in a side view and protrudes rearward from the lower portion on the rear edge of the metal frame 46. The upper portion of the rear end of the first fixing-unit positioning part 64 is exposed on the right side of the first resin frame 45 through the first fixing-unit boss hole 53, as illustrated in FIG. 11.

As shown in FIG. 11, four of the first LED-positioning members 66 are provided at intervals in the front-rear direction to correspond to the four LED units 12. The first LED-positioning members 66 are supported on the right surface of the metal frame 46, with one positioned on the rear side of each frame opening 60.

Each first LED-positioning member 66 includes a support part 69, a pivoting shaft 68, and a pivoting part 67, as shown in FIG. 12.

The support part 69 has a generally rectangular shape in a side view and is elongated in the left-right direction. The support part 69 is fixed to the right surface of the metal frame 46.

The pivoting shaft 68 has a general columnar shape extending in the left-right direction. The pivoting shaft 68 is supported on the lower rear side of the support part 69, on the right surface of the metal frame 46, so as to be incapable of rotating relative to the metal frame 46.

The pivoting part 67 has a general L-shape in a side view. Specifically, the pivoting part 67 is integrally configured of a head part 77, and a body part 78.

The head part 77 is generally rectangular is a side view and elongated in the front-rear direction. The body part 78 is also generally rectangular in a side view and extends continuously downward from the bottom surface of the bead part 77 on the rear end thereof. The bottom end of the body part 78 is pivotally supported on the pivoting shaft 68 so that the pivoting part 67 can pivot as a whole. A spring member (not shown)

constantly urges the pivoting part 67 counterclockwise in a right side view for placing the front end of the head part 77 in contact with the top portion of the support part 69.

As shown in FIG. 12, the first LED-positioning member 66 is disposed in the corresponding first LED groove 54 via the positioning through-hole 59 formed in the first resin frame 45. As shown in FIG. 11, the top end of the first LED-positioning member 66, i.e., the support part 69 and the head part 77, is exposed on the right side of the first resin frame 45 through the first LED groove 54.

(1-3) Support Plate

As shown in FIGS. 8 and 9, a support plate 47 is provided on the left wall 41, and specifically on the left side of the metal frame 46. The support plate 47 is fixed to the left surface of the first resin frame 45 with the metal frame 46 interposed therebetween. The support plate 47 has a generally flat plate shape that is substantially rectangular in a side view. The support plate 47 is formed of metal. The support plate 47 is provided wills the motor 70, the drum-body couplings 71, the body-side development couplings 72, development gears 79, and drum gears 94.

As shown in FIG. 9, the motor 70 is supported on the left surface of the support plate 47 and configured to generate a drive force.

As shown in FIG. 8, four drum-body couplings 71 are arranged on the right surface of the support plate 47 at intervals in the front-rear direction so as to be in confrontation with the four drum-coupling insertion holes 49 in the left-right direction.

The drum-body couplings 71 have a general columnar shape extending in the left-right direction. Gear teeth are formed around the entire outer circumference of the left ends of the drum-body couplings 71. The drum-body couplings 71 are rotatably supported on the right surface of the support plate 47. The drive force generated by the motor 70 is transmitted to the drum-body couplings 71 via corresponding gear trains (not shown). Each drum-body coupling 71 is configured to move between a retracted position spaced away from the left side of the corresponding drum-coupling insertion hole 49, and an advanced position advanced through the corresponding drum-coupling insertion hole 49 into the corresponding first guiding groove 56.

The body-side development couplings 72 are disposed on the support plate 47 at positions obliquely above and forward of the corresponding drum-body couplings 71 and are in confrontation with the respective development-coupling insertion holes 50 in the left-right direction. The body-side development couplings 72 have a general columnar shape extending in the left-right direction. Gear teeth are formed around the entire outer circumferential surface of the left end of each body-side development coupling 72. The body-side development couplings 72 are also rotatably supported on the right surface of the support plate 47. The drive force generated by the motor 70 is transmitted to the body-side development couplings 72 via corresponding gear trains (not show). Each body-side development coupling 72 is configured to move between a retracted position spaced away from to the left side of the development-coupling insertion hole 50, and an advanced position advanced through the corresponding development-coupling insertion hole 50 into the corresponding first guiding groove 56.

The development gears 19 have a general disk shape. Gear teeth are formed around the entire outer circumferential surface of the development gears 79. The development gears 79 are rotatably supported on the right surface of the support plate 47 and engage with gear teeth on the body-side development couplings 72. The development gears 79 transmit a drive force received from the gear trains (not shown) to the body-side development couplings 72.

The drum gears 94 have a general disk shape. Gear teeth are formed around the entire outer circumferential surface of the drum gears 94. The drum gears 94 are rotatably supported on the right surface of the support plate 47 and are engaged with the gear teeth of the drum-body couplings 71. The drum gears 94 transmit a drive force received from the gear trains (not shown) to the drum-body couplings 71.

(2) Right Wall

Figure 13:
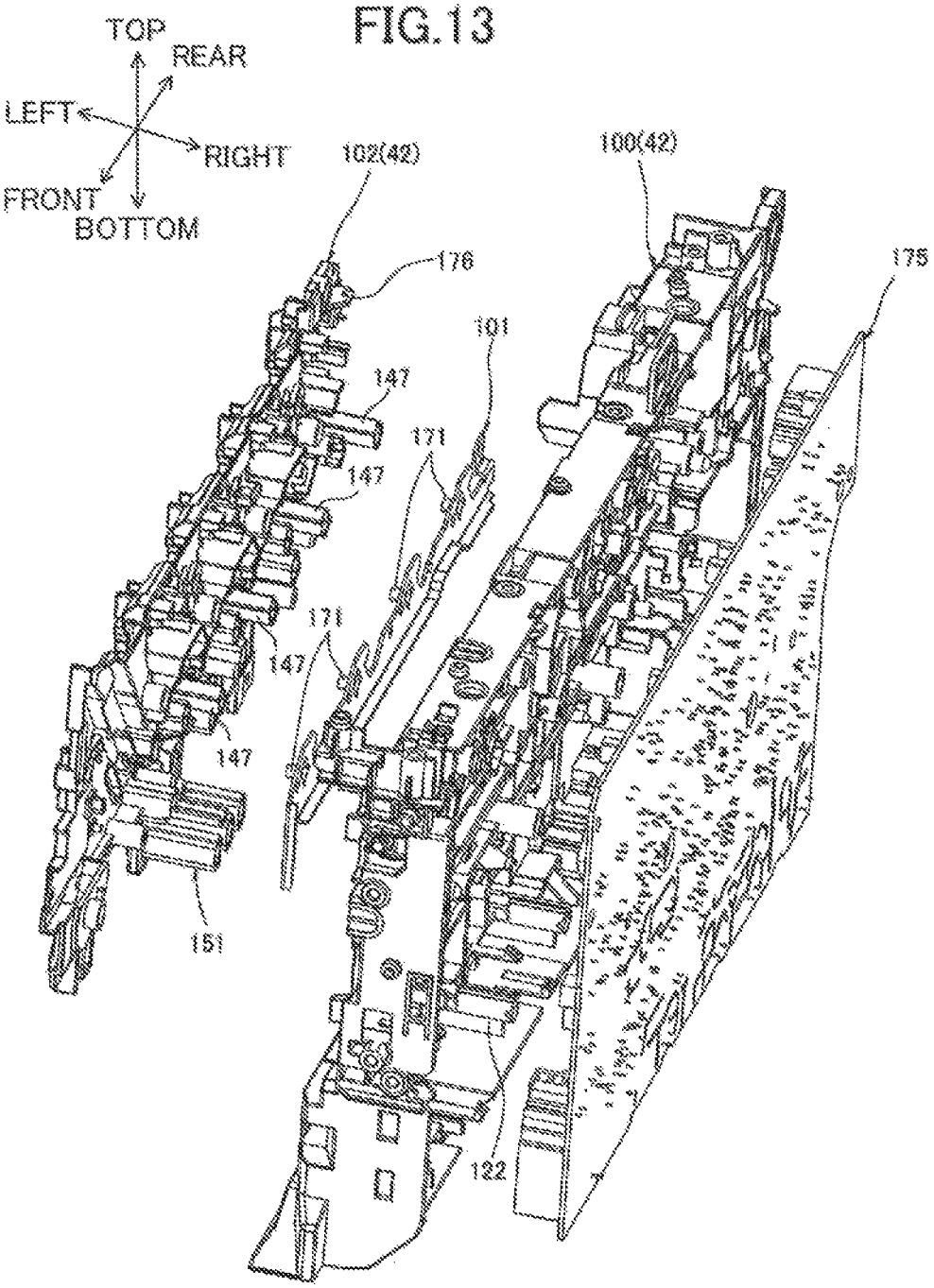
FIG. 13 is an exploded perspective view of a right wall of the main casing as viewed from diagonally forward-right.

As shown in FIG. 13, the right wall 42 includes a second resin frame 100, and a drum support frame 102.

(2-1) Second Resin Frame

Figure 14:
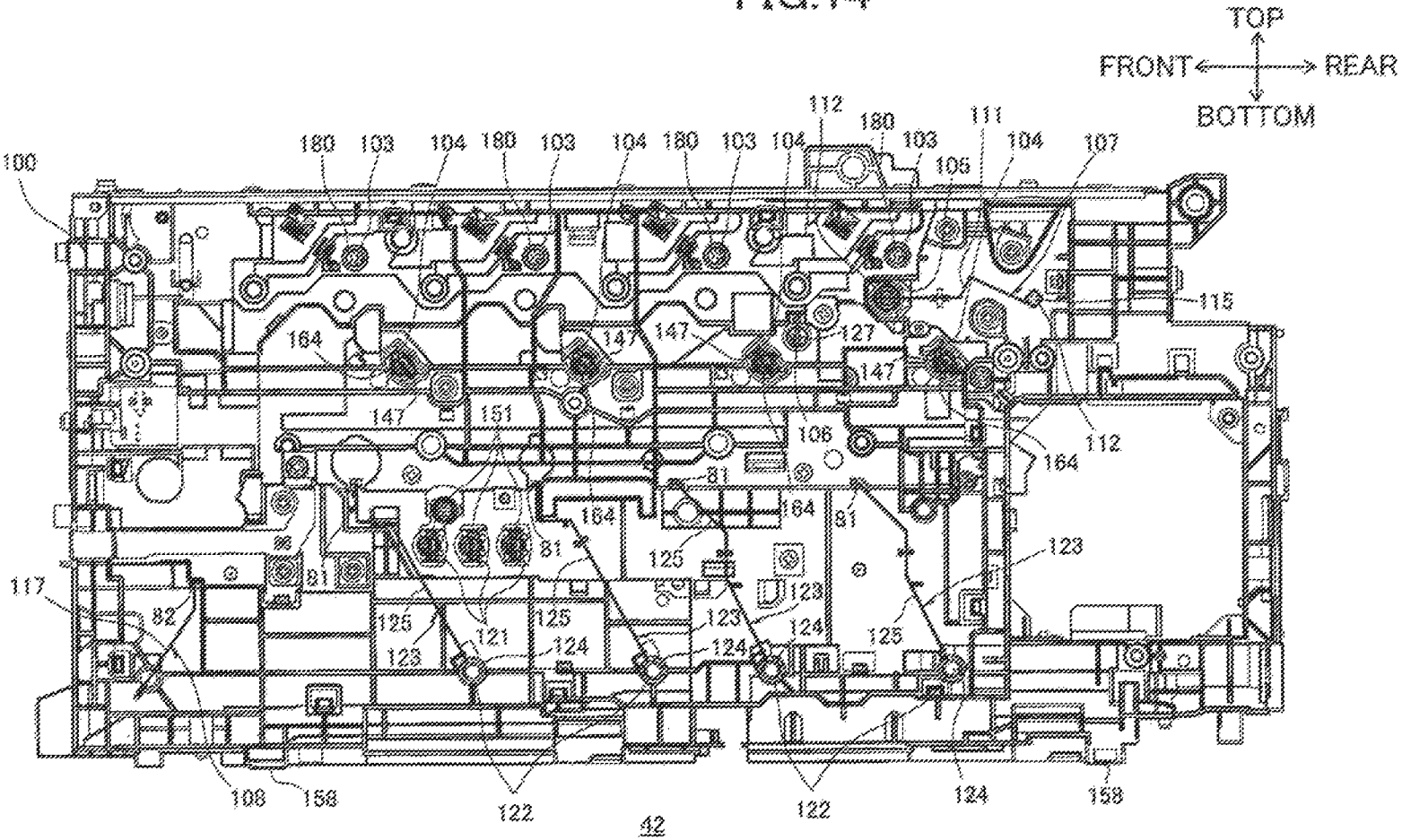
FIG. 14 is a right side view of the right wall of the main casing.

As shown in FIG. 14, the second resin frame 100 has a generally flat plate shape that is substantially rectangular in a side view and elongated in the front-rear direction.

(2-2) Drum-Support Frame

The second resin frame 100 is formed of polystyrene or another resin material. The front-rear and vertical dimensions of the second resin frame 100 are approximately equal to those of the first resin frame 45.

The second resin frame 100 has the upper portion formed with development-electrode insertion holes 103, grid-electrode insertion holes 104, a wire-electrode insertion hole 105, and a cleaning-wire exposing hole 106. The second resin frame 100 has the lower portion formed with a belt-electrode insertion hole 121, and a second sheet-feed boss groove 179 shown in FIG. 16.

Four of the development-electrode insertion holes 103 are formed in the upper edge of the second resin frame 100 at intervals in the front-rear direction. The development-electrode insertion holes 103 are generally circular in a side new and penetrate the second resin frame 100. The diameter of the development-electrode insertion holes 103 is approximately equal to the outer diameter of a development spring part 180 described later.

Four of the grid-electrode insertion holes 104 are formed in the approximate vertical center region of the second resin frame 100 at intervals in the front-rear direction. One of the grid-electrode insertion holes 104 is positioned diagonally below and rearward of the corresponding development-electrode insertion hole 103. The grid-electrode insertion holes 104 are generally rectangular in a side view and penetrate the second resin frame 100 in the left-right direction. The dimensions of the grid-electrode insertion hole 104 are slightly greater than the outer dimensions of a grid-spring support part 147 described later.

The wire-electrode insertion hole 103 is formed diagonally above and forward of the rearmost grid-electrode insertion hole 104 and beneath, the rearmost development-electrode insertion hole 103. The dimensions of the wire-electrode insertion hole 105 are slightly greater than the outer diameter of a first wire spring part 112 described later.

The cleaning-wire exposing hole 106 is formed diagonally below and forward of the wire-electrode insertion hole 105 and diagonally above and rearward of the grid-electrode insertion hole 104 positioned second from the rear side. The cleaning-wire exposing hole 106 is generally circular in a side view and penetrates the second resin frame 100 in the left-right direction.

The second resin frame 100 has the lower portion formed with a plurality of the belt-electrode insertion holes 121 at the approximate front-rear center thereof. The belt-electrode insertion holes 121 are generally rectangular in a side view and penetrate the second resin frame 100 in the left-right direction. The inner dimensions of the belt-electrode insertion hole 121 are larger than the outer diameter of a belt-spring support unit 151 described later.

Figure 16:
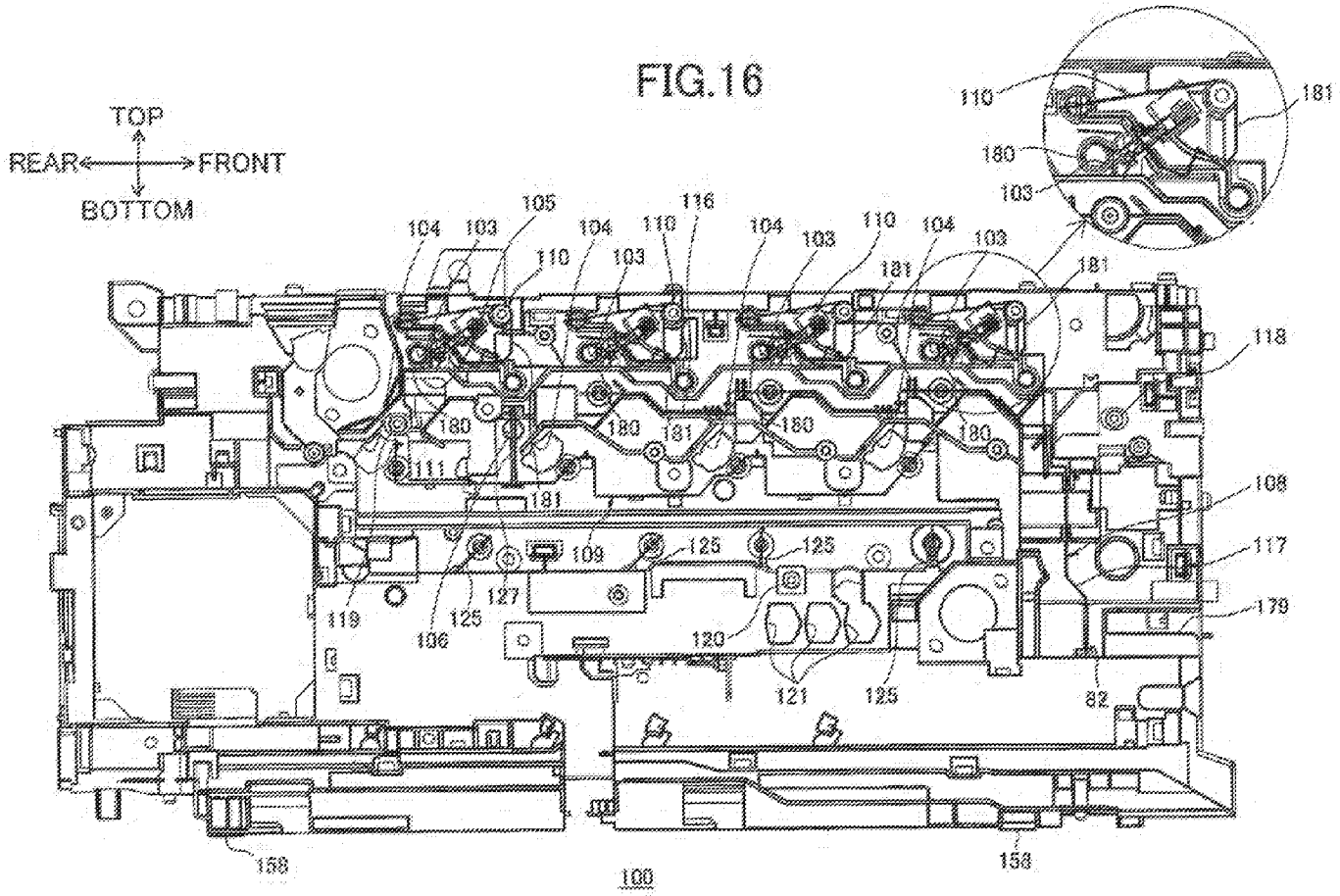
FIG. 16 is a left side view of a second resin frame of the right wall shown in FIG. 13.
Figure 20:
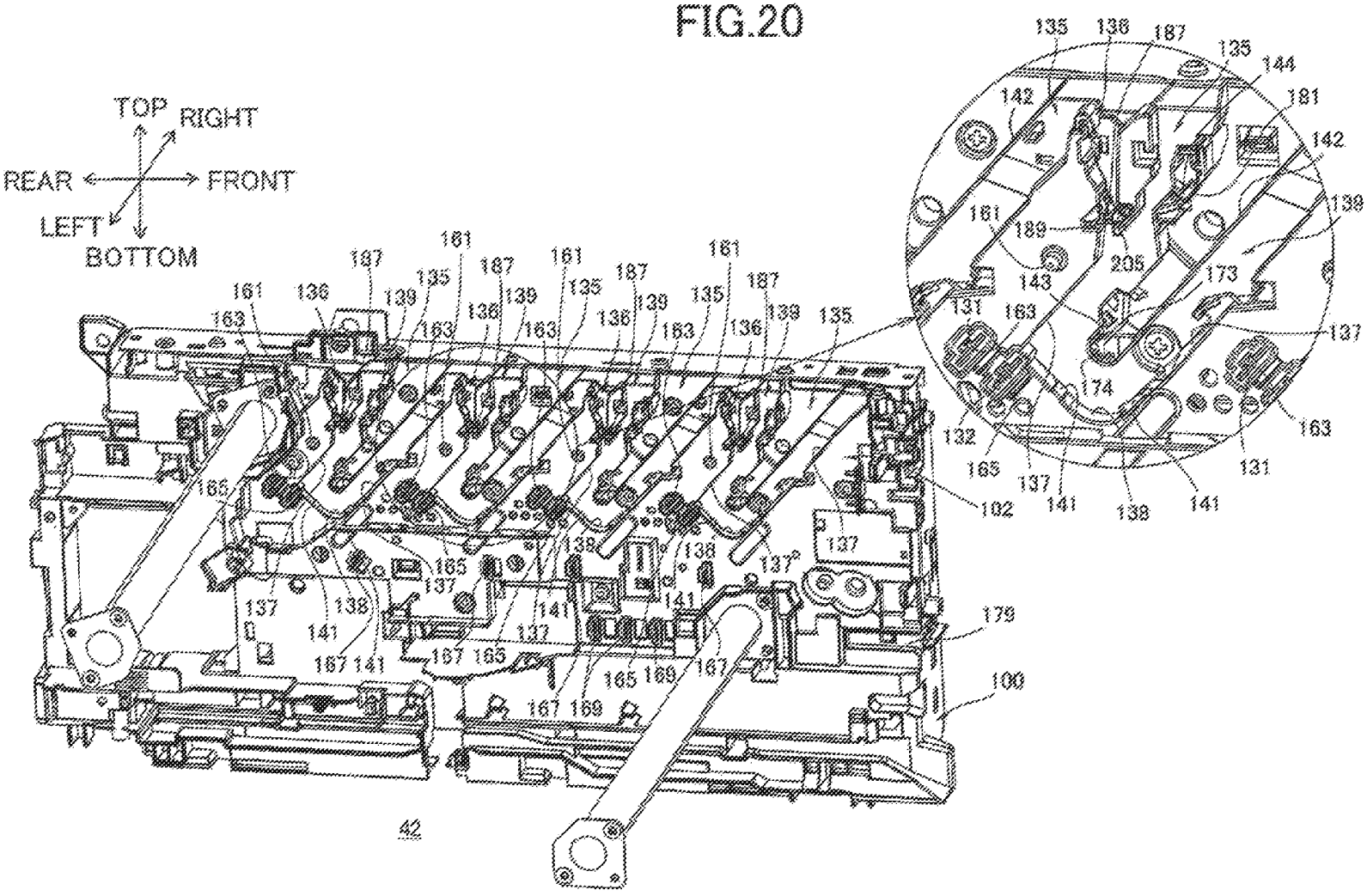
FIG. 20 is a perspective view of the right wall shown in FIG. 15 as viewed from diagonally forward-left.

As shown in FIG. 16, the second sheet-feed boss groove 179 is formed in the lower portion of the second resin frame 100. The second sheet-feed boss groove 179 is formed in the left surface of the second resin frame 100 at a position opposing the first sheet-feed boss groove 51 formed in the first resin frame 45 shown in FIG. 11 in the left-right direction. As shown in FIG. 20, the second sheet-feed boss groove 179 has a generally square U-shape in a side view and extends rearward from the font edge of the second resin frame 100. The second sheet-feed boss groove 179 is recessed into the left surface of the second resin frame 100. As shown in FIG. 22, the vertical dimension of the second sheet-feed boss groove 179 is approximately equal to the outer diameter of the second sheet-feed boss 185 described later.

As shown, in FIG. 14, a wire-spring support, part 115 and first transfer-spring support parts 122 are integrally provided on the right surface of the second resin frame 100.

The wire-spring support part 115 is provided on the upper portion of the second resin frame 100 near the rear end thereof and is positioned to the rear of the wire-electrode insertion hole 105 and spaced apart therefrom. The wire-spring support part 115 has a general plus-sign shape in a side view and protrudes rightward from the right surface of the second resin frame 100. The vertical and front-rear dimensions of the wire-spring support part 115 are approximately equal to the inner diameter of the first wire spring part 112 described later.

Four of the first transfer-spring support parts 122 are provided on the lower portion of the second resin frame 100 at intervals in the front-rear direction. The first transfer-spring support parts 122 have a general C-shape in a side view and protrude rightward from the right surface of the second resin frame 100. The inner diameter of each first transfer-spring support part 122 is approximately equal to the outer diameter of a first transfer spring part 124 described later.

As shown in FIG. 16, a first protrusion 118, a second protrusion 119, and a third protrusion 120 are integrally provided on the left surface of the second resin frame 100.

The first protrusion 118 and the second protrusion 119 are formed in the upper portion of the second resin frame 100 and are spaced apart in the front-rear direction. The first protrusion 118 has a general columnar shape and protrudes leftward from the left surface of the second resin frame 100 near the front edge of the same. The second protrusion 119 also has a general columnar shape and protrudes leftward from the left surface of the second resin frame 100 at a position diagonally below and rearward of the wire-electrode insertion hole 105.

The third protrusion 120 is provided in the lower portion of the second resin frame 100 in the approximate front-rear center thereof and is positioned immediately above the belt-electrode insertion holes 121. The third protrusion 120 has a general columnar shape and protrudes leftward from the left surface of the second resin frame 100.

As shown in FIG. 14, a wire relay electrode 107 and transfer relay electrodes 123 are supported on the right surface of the second resin frame 100.

The wire relay electrode 107 is formed of an electrically conductive material, such as metal, and is integrally configured of a first wire spring part 112, and a connecting wire 111.

Figure 18:
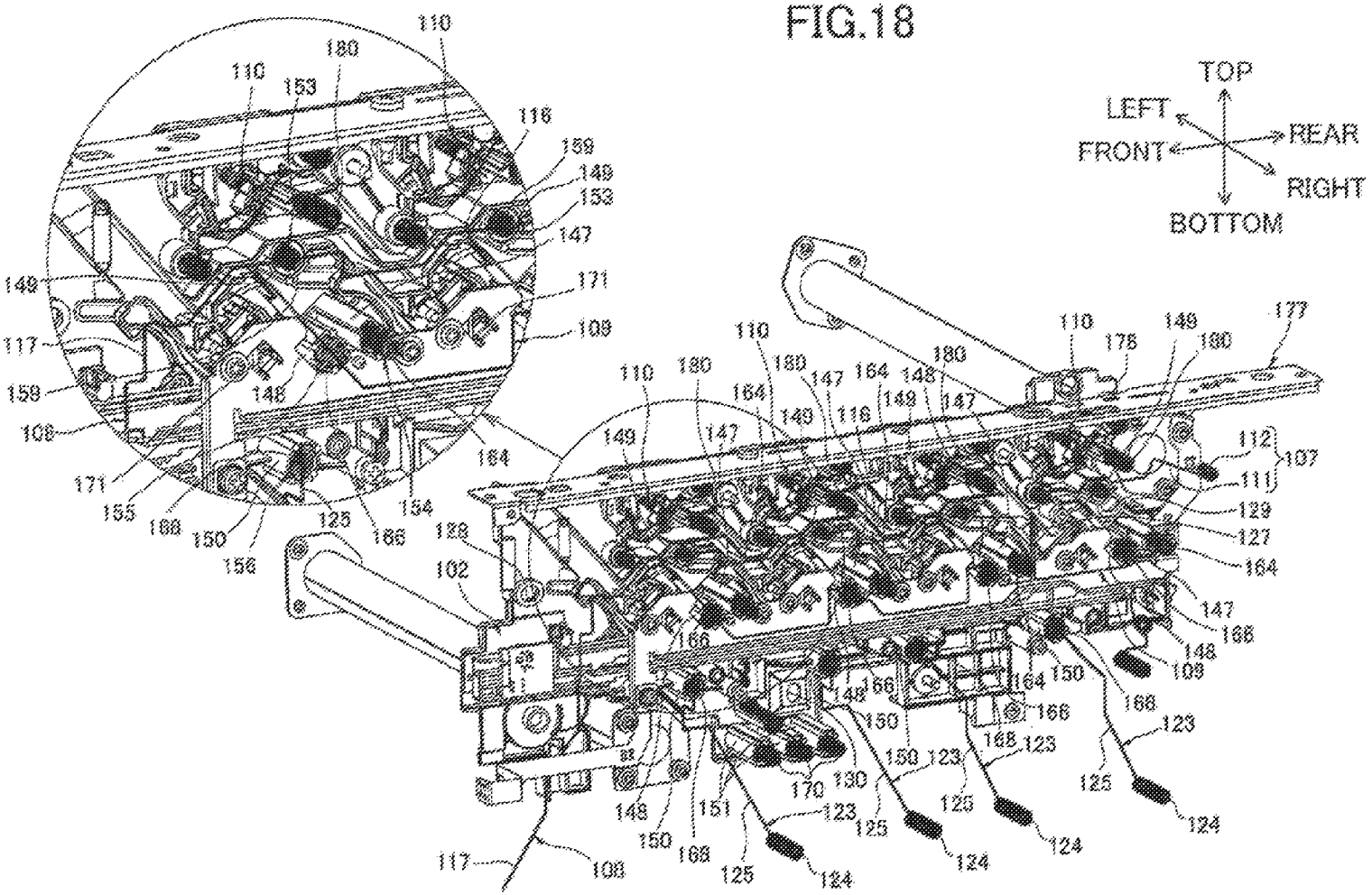
FIG. 18 is a perspective view of the right wall shown in FIG. 15 without a second resin frame as viewed from diagonally forward-right.

As shown in FIG. 18, the first wire spring part 112 is shaped like an air-core coil that expands in the left-right direction. The left-right dimension of the first wire spring part 112 is greater than the left-right dimension of the wire-spring support part 115, as shown in FIG. 15.

As shown in FIG. 14, the connecting wire 111 is formed continuously from the left end of the first wire spring part 112 and extends linearly forward therefrom.

The wire relay electrode 107 is supported on the right surface of the second resin frame 100 by inserting the wire-spring support part 115 into the internal space of the first wire spring part 112. At this time, the front end of the connecting wire 111 is exposed on the left side of the second resin frame 100 through the wire-electrode insertion hole 105, as illustrated in FIG. 16.

Figure 15:
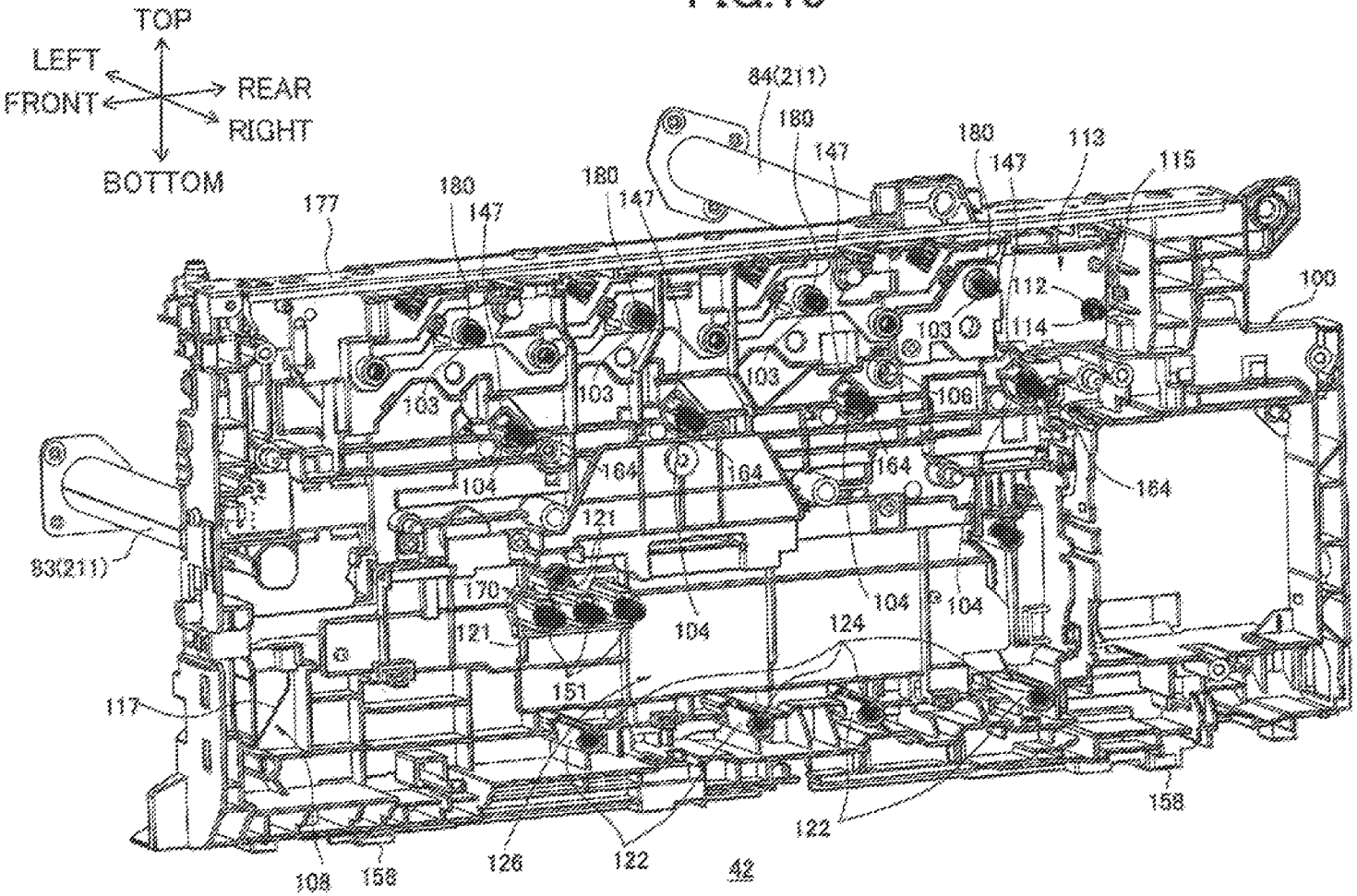
FIG. 15 is a perspective view of the right wall shown in FIG. 14 as viewed from diagonally forward-right.

The connecting wire 111 of the wire relay electrode 107 is covered on the right side by a connecting-wire cover 113 shown in FIG. 15. The connecting-wire cover 113 is formed of polystyrene or another resin material. The connecting-wire cover 113 has a generally flat plate shape and is rectangular in a side view. The connecting-wire covet 113 is formed with a wire-spring insertion hole 114. The wire-spring insertion hole 114 is formed in the rear side of the connecting-wire cover 113 at a position in the approximate vertical center thereof. The wire-spring insertion hole 114 is generally circular in a side view and penetrates the connecting-wire cover 113 in the left-right direction.

The connecting-wire cover 113 is fixed to the right surface of the second resin frame 100 for covering the connecting wire 111 of the wire relay electrode 107 from the right side. The right end of the first wire spring part 112 protrudes rightward from the connecting-wire cover 113 through the wire-spring insertion hole 114.

As shown in FIG. 14, four of the transfer relay electrodes 123 are provided for the four transfer rollers 20 shown in FIG. 1. The transfer relay electrodes 123 are formed of an electrically conductive material, such as metal. Each transfer relay electrode 123 is integrally formed of the first transfer spring part 124, and a transfer wiring part 125.

As shown in FIG. 18, the first transfer spring part 124 has an air-core coil shape that expands in the left-right direction.

As shown in FIG. 14, the transfer wiring part 125 is formed continuously with the left end of the first wire spring part 112 and extends linearly in a direction diagonally upward and forward therefrom.

Each transfer relay electrode 123 is supported on the second resin frame 100 by inserting the first transfer spring part 124 into the corresponding first transfer-spring support part 122 and by anchoring the transfer wiring part 125 on the right surface of the second resin frame 100. At this time, the right end of the first transfer spring part 124 is exposed on the right side of the second resin frame 100, as shown in FIG. 15.

As shown in FIGS. 14 and 16, the distal end, i.e., upper end, of each transfer wiring part 125 passes from the right surface of the second resin frame 100 to the left surface through a respective through-hole 81 formed in the second resin frame 100 and is exposed on the left side of the second resin frame 100.

As shown in FIG. 15, a transfer wiring cover 126 covers the transfer wiring part 125 of the transfer relay electrode 123 from the right side thereof. The transfer wiring cover 126 is formed of polystyrene or another resin material and has a generally flat plate shape that is substantially rectangular in a side view. The transfer wiring cover 126 is fixed to the right surface of the second resin frame 100 so as to cover the transfer wiring part 125 from the right side.

As shown in FIG. 16, development electrodes 110, a relay wire 108, and a cleaning wire 109 are supported on the left surface of the second resin frame 100.

Four of the development electrodes 110 are provided for the four developer cartridges 25 shown in FIG. 1. The development electrodes 110 are provided on the left surface of the second resin frame 100 near the upper edge thereof and are spaced at intervals in the front-rear direction.

The development electrodes 110 are formed of an electrically conductive material, such as metal, and are each integrally provided with the development spring part 180, and a development contact part 181.

The development spring part 180 constitutes the rear end of the development electrode 110. As shown in FIG. 18, the development spring part 180 has an air-core coil shape that expands in the left-right direction.

As shown in FIG. 16, the development contact part 181 is provided on the front end of the development, spring part 180 and extends lineally in the vertical direction.

Each of the development electrodes 110 is supported on the from surface of the second resin frame 100 at the top edge thereof by inserting the development spring part 180 into the corresponding development-electrode insertion hole 103. In this state, the right end of the development spring part 180 is exposed on the right side of the second resin frame 100 through the development-electrode insertion hole 103, as shown in FIG. 15.

As shown in FIG. 16, the relay wire 108 is formed linearly, with a general L-shaped bend when viewed from the side. The relay wire 108 is formed of an electrically conductive material, such as metal. The relay wire 108 includes a first part 116 extending in the front-rear direction, and a second part 117 extending vertically.

The first part 116 is laid out between the plurality of development-electrode insertion holes 103 and the plurality of grid-electrode insertion holes 104 with respect to the vertical.

The second part 117 is formed continuously with the front end of the first part 116 and bends and extends downward therefrom. The second part 117 is disposed on the left surface of the development electrode 110 near the front end thereof.

The relay wire 108 is fixed to the second resin frame 100 by anchoring the first part 116 on the second resin frame 100 beneath the development-electrode insertion holes 103, The lower end of the second part 117 passes from the left surface of the second resin frame 100 to the right surface through a through-hole 82 and is exposed on the right side of the second resin frame 100, as shown in FIG. 14.

As shown in FIG. 16, the cleaning wire 109 is formed linearly, extending in the front-rear direction. The cleaning wire 109 is formed of an electrically conductive material, such as metal. The cleaning wire 109 is integrally provided with a connecting part 127 provided a distance of proximately one-third the front-rear length of the cleaning wire 109 from the rear end thereof.

The connecting part 127 has a general U-shape in a side view with the bottom side open. The connecting part 127 is formed by first bending the cleaning wire 109 upward, then doubling the cleaning wire 109 back and downward.

The cleaning wire 109 is disposed on the left surface of the second resin frame 100 in the approximate vertical center thereof. The cleaning wire 109 is anchored on the left surface of the second resin frame 100 at positions diagonally below and forward of each grid-electrode insertion hole 104, thereby fixing the cleaning wire 109 to the second resin frame 100. As shown in FIG. 14, the top end of the connecting part 127 constituting the cleaning wire 109 is exposed on the right side of the second resin frame 100 through the cleaning-wire exposing hole 106.

As shown in FIG. 8, a second reinforcing plate 177 is provided on the top edge of the second resin frame 100 as a separate, member from the second resin frame 100. The second reinforcing plate 177 is formed of metal and has a generally flat plate shape that is substantially rectangular in a plan view and elongated in the front-rear direction. The second reinforcing plate 177 is formed with an engaging hole 178.

The engaging hole 178 is generally rectangular in a plan view and penetrates the second reinforcing plate 177 at a position approximately one-fourth the front-rear length of the second reinforcing plate 177 from the rear end thereof.

As shown in FIG. 14, a plurality of feet 158 is integrally provided on the bottom edge of the second resin frame 100 for contacting the surface on which the main casing 2 is placed. More specifically, two of the feet 158 are provided in the preferred embodiment. The feet 158 are spaced apart from each other in the front-rear direction. The feet 158 are generally rectangular in a side view and protrude downward from the bottom edge of the second resin frame 100.

The second resin frame 100 is formed of a size capable of covering the entire image-forming unit 4 shown in FIG. 1 in a side view. The second resin frame 100 functions as a main frame member constituting the right side of the printer 1.

(2-2) Drum Support Frame

Figure 17:
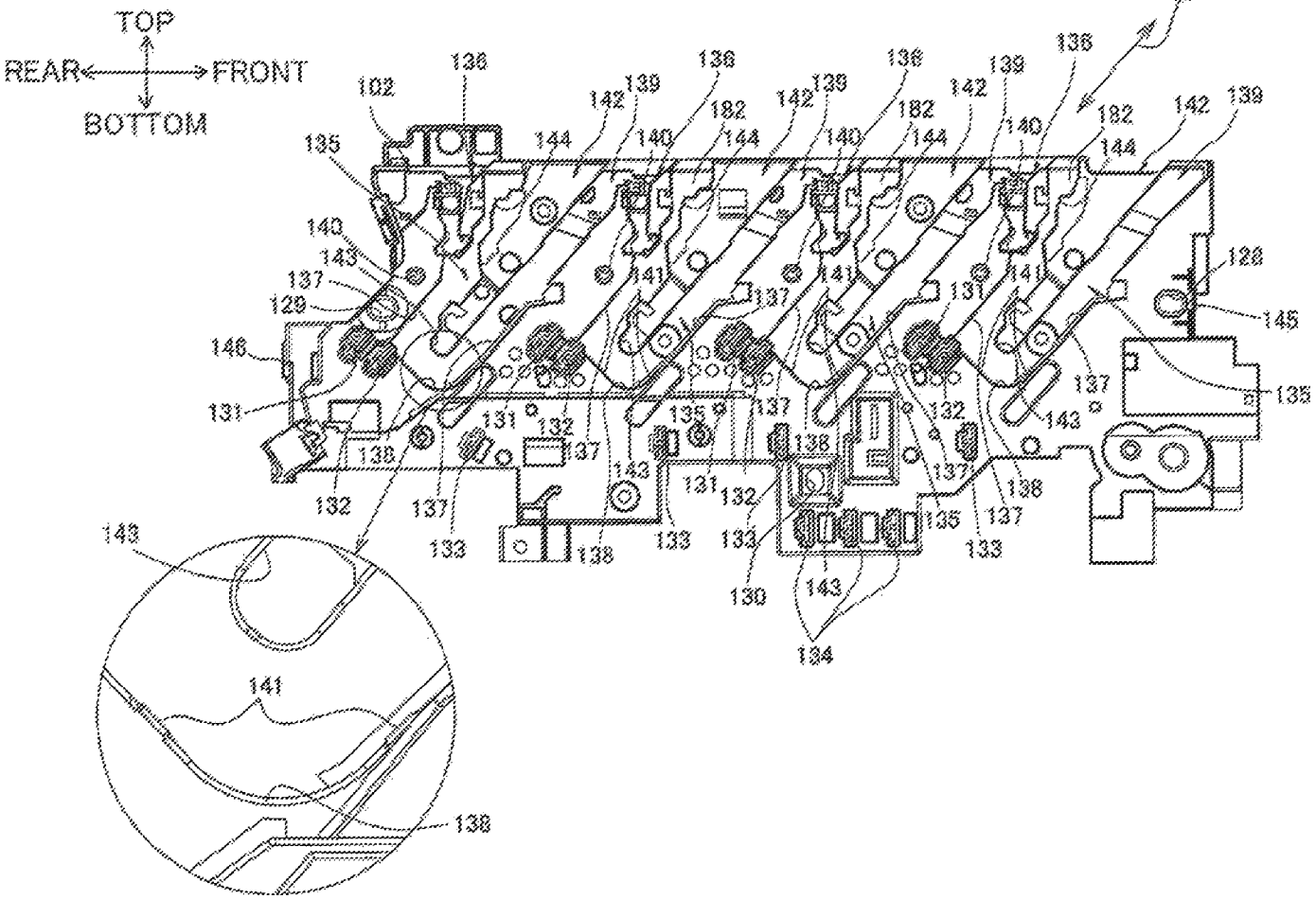
FIG. 17 is a left side view of a drum support frame of the right wall shown in FIG. 13.

As shown in FIG. 17, the drum support frame 102 is formed in a generally flat plate shape that is substantially rectangular in a side view and elongated in the front-rear direction. The drum support frame 102 is formed of a glass fiber reinforced polycarbonate or other resin material and has a smaller coefficient of thermal expansion than the polystyrene or other resin used to form the second resin frame 100.

As shown in FIGS. 13 and 20, the drum support frame 102 is disposed on the left side of the second resin frame 100 and is fixed to the left surface on the upper portion of the same. In a left-right projection, the entire drum support frame 102 falls within the projected surface of the second resin frame 100, That is, the projected surface of the drum support frame 102 is contained inside the outer peripheral edges of the projected surface of the second resin frame 100.

As shown in FIG. 17, the drum support frame 102 includes second drum guide parts 135, and second LED grooves 136.

Four of the second drum guide parts 135 are provided at intervals in the front-rear direction so as to be in confrontation with the four first drum guide parts 48 formed in the first resin frame 45 in the left-right direction.

Each of the second drum guide parts 135 is formed in the top edge of the drum support frame 102 and is recessed diagonally downward and rearward. The second drum guide parts 135 are generally U-shaped in a side view. The second drum guide parts 135 are recessed rightward in the left surface of the second resin frame 100, as shown in FIG. 20, and expand rightward from the right surface of the second resin frame 100.

As shown in FIG. 17, each second drum guide part 135 is integrally configured of a pair of front and rear second rail parts 137, a second curved part 138, and a second enclosing part 182.

Each of the second rail parts 137 is shaped to appear bent rightward from the left surface of the drum support frame 102. The second rail parts 137 extend along a direction sloping downward and rearward from the top edge of the drum support frame 102 (i.e., in the mounting direction X described later). The second rail parts 137 are spaced apart in the front-rear direction by a gap greater than the outer diameter of the bearing member 32.

The second curved part 138 is provided to connect the lower edges of the second rail parts 137 to each other and is formed continuously with both lower edges. The second curved part 138 has a generally semicircular shape in a side view, with its convex side facing obliquely downward and rearward.

A pair of second positioning protrusions 141 is integrally provided on the second curved part 138. The second positioning protrusions 141 are spaced apart along the circumferential direction of the second curved part 138. Each second positioning protrusion 141 is generally rectangular in a side view and protrudes radially inward from the inner circumferential surface of the second curved part 138.

More specifically, the rear second positioning protrusion 141 among the pair protrudes obliquely upward and forward from the lower rear edge on the inner circumferential surface of the second curved part 138, while the front second positioning protrusion 141 protrudes obliquely upward and rearward from the lower front edge on the inner circumferential surface of the second curved part 138. As shown in FIG. 6, the second positioning protrusions 141 are disposed at positions aligned with the first positioning protrusions 61 in the left-right direction.

The second enclosing part 182 is coupled with the right edge of the corresponding second rail parts 137 and the second curved part 138.

A second guiding groove 139 is defined by the rear surface of the front second rail part 137, the front surface of the tear second rail part 137, the inner circumferential surface of the second curved part 138, and the left surface of the second enclosing part 182.

Each second drum guide part 135 is formed with a shaft fitting groove 142. As shown in FIG. 17, the shaft fitting grooves 142 are generally U-shaped in a side view and extend diagonally downward and rearward from the top edges of the corresponding second enclosing parts 182 near the approximate front-rear center thereof. The shaft fitting groove 142 is recessed rightward in the left surface of the second enclosing part 182 and expands further rightward from the right surface of the second enclosing part 182. Hence, one of the shaft fitting grooves 142 is positioned in front of each development electrode 110.

Figure 21:
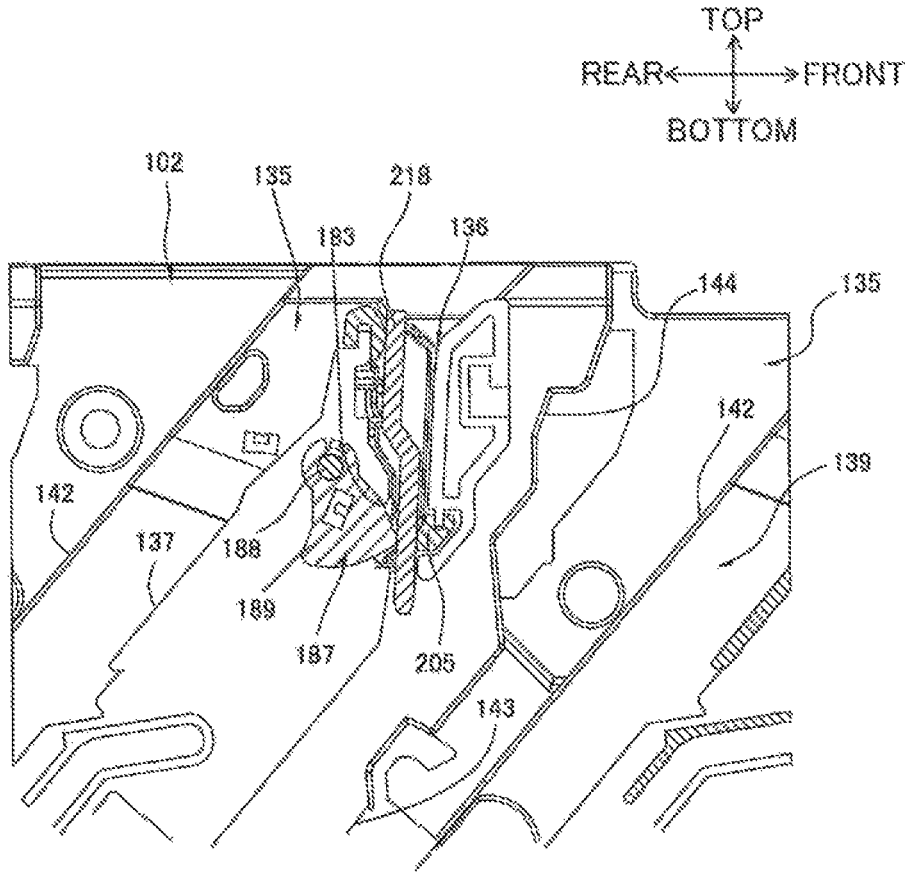
FIG. 21 is a cross-sectional view of a second LED positioning member shown in FIG. 20.

As shown in FIG. 21, each shaft fitting groove 142 has the rear wall formed with a conducting-member exposing hole 143 and a development-electrode exposing hole 144.

The conducting-member exposing hole 143 is formed in the bottom of the rear wall of the shaft fitting groove 142 and penetrates the rear wall in the front-rear direction.

As shown in FIG. 16, the development-electrode exposing hole 144 is formed above the conducting-member exposing hole 143 in the rear wall of the shaft fitting groove 142 and penetrates the rear wall in the front-rear direction at a position corresponding to the development electrode 110. The development contact part 181 of the corresponding development electrode 110 is exposed on the front side of the rear wall defining the shaft fitting groove 142 through the corresponding development-electrode exposing hole 144 as shown in FIG. 20.

Four of the second LED grooves 136 are formed in the drum support frame 102 at intervals in the front-rear direction. The second LED grooves 136 are aligned with the first LED grooves 54 formed in the first resin frame 45 in the left-right direction and are positioned rearward of each of the second drum guide parts 135. As shown in FIG. 17, the second LED grooves 136 have a generally square U-shape in a side view. The second LED grooves 136 are recessed downward in the top edge of the drum support frame 102 and expand rightward from the right surface of the same.

As shown in FIG. 21, a clamping part 205 is supported in the second LED groove 136 on the lower end of the front wall defining the same. A pivoting-part opening 183 is formed at the lower end of the rear wall of the second LED groove 136.

As shown in FIG. 17, the drum support frame 102 is formed with a first fitting hole 128, a second fitting hole 129, and a third fitting hole 130.

The first fitting hole 128 and the second fitting hole 129 are formed at positions spaced apart in the front-rear direction.

More specifically, the first fitting hole 128 is formed in the front portion of the drum support frame 102 at the approximate vertical center thereof so as to penetrate the drum support frame 102 in the left-right direction. The first fitting hole 128 has a general elliptical shape in a side view elongated in the front-rear direction. As shown in FIG. 22, the vertical dimension of the first fitting hole 128 is approximately equal to the outer diameter of the first protrusion 118, while the front-rear dimension of the first fitting hole 128 is greater than the outer diameter of the first protrusion 118. The first protrusion 118 is inserted into the first fitting hole 128.

As shown in FIG. 17, the second fitting hole 129 is formed in the rear end of the drum support frame 102 at the approximate vertical center thereof and penetrates the drum support frame 102 in the left-right direction. The second fitting hole 129 has a general elliptical shape in a side view elongated in the front-rear direction. As shown in FIG. 22, the vertical dimension of the second fitting hole 129 is approximately equal to the outer diameter of the second protrusion 119, while the front-rear dimension of the second fitting hole 129 is greater than the outer diameter of the second protrusion 119. The second protrusion 119 is inserted into the second fitting hole 129.

As shown in FIG. 17, the third fitting hole 130 is formed in the lower portion of the drum support frame 102 at approximately the front-rear center thereof and penetrates the drum support frame 102 in the left-right direction. The third fitting hole 130 has a general elliptical shape in a side view that is elongated vertically. Thus, the third fitting hole 130 is positioned between the first fitting hole 128 and the second fitting hole 129 with respect to the front-rear direction. As shown in FIG. 22, the vertical dimension of the third fitting hole 130 is greater than the outer diameter of the third protrusion 120, while the front-rear dimension of the third fitting hole 130 is approximately equal to the outer diameter of the third protrusion 120. The third protrusion 120 is inserted into the third fitting hole 130.

As shown in FIG. 17, a second supply positioning part 145, a second fixing-unit positioning part 146, and a hook-shaped part 176 (see FIG. 23) are integrally provided on the drum support frame 102.

The second supply positioning part 145 is formed on the front edge of the drum support frame 102 at approximately the vertical center thereof. The second supply positioning part 145 is generally rectangular in a side view and protrudes forward from the front edge of the drum support frame 102.

The second fixing-unit positioning part 146 is formed on the rear edge of the drum support frame 102 at approximately the vertical center thereof. The second fixing-unit positioning part 146 is generally rectangular in a side view and protrudes rearward from the rear edge.

Figure 23:
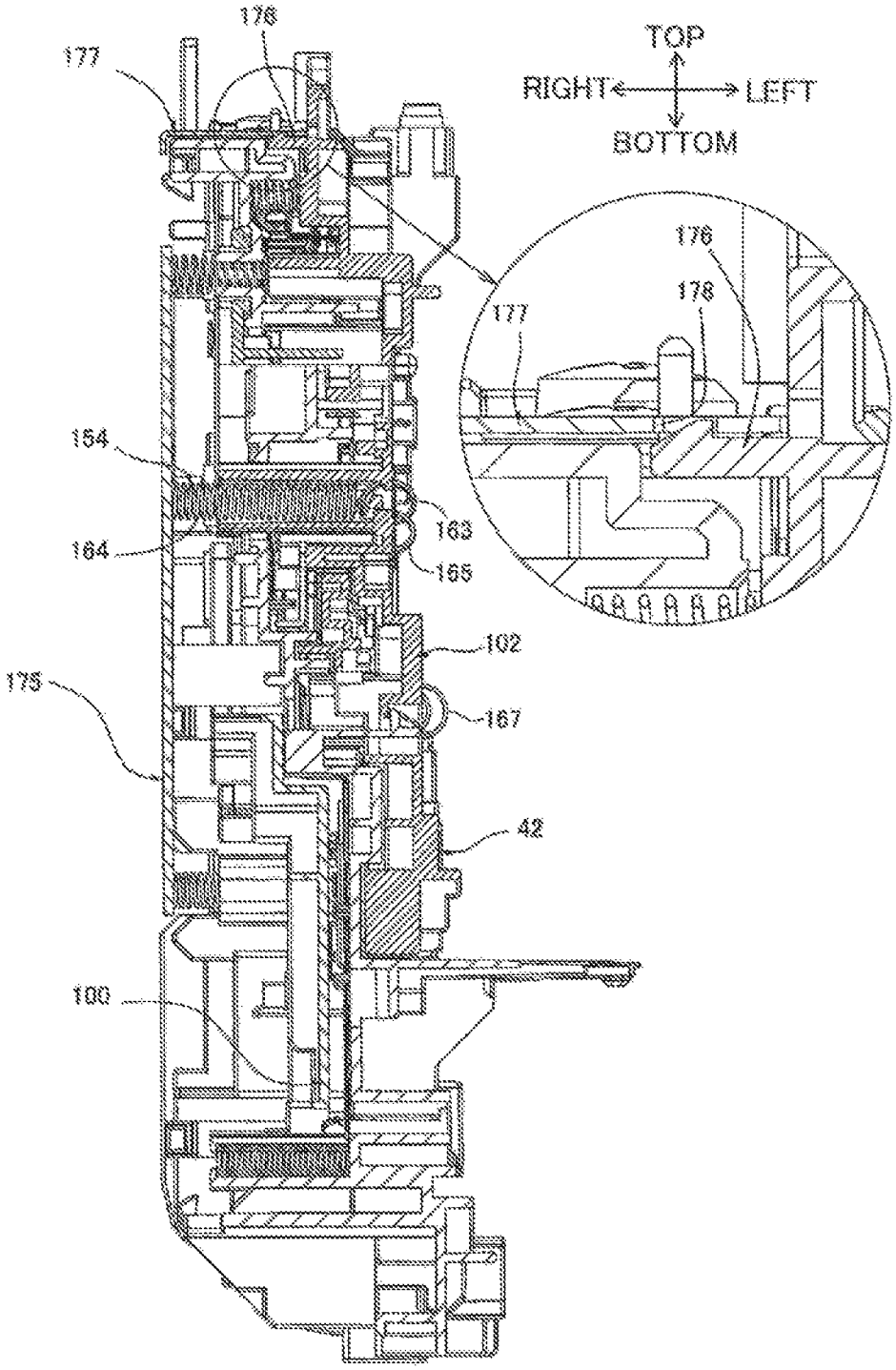
FIG. 23 is across-sectional view taken along a line XXIII-XXIII in FIG. 22.

As shown in FIG. 23, the hook-shaped part 176 has a generally flat plate shape and protrudes rightward from the upper edge of the drum support frame 102. The right end of the hook-shaped part 176 is bent upward to form a hook-like shape in cross section. The right end of the hook-shaped part 176 is engaged in the engaging hole 178 formed in the second reinforcing plate 177 from below.

As shown in FIG. 18, the drum support frame 102 has the right surface provided with grid-spring support parts 147, cleaning-spring support parts 148, wire-spring support parts 149, second transfer-spring support parts 150, belt-spring support parts 151, and second LED-positioning members 187 (see FIG. 20).

Four of the grid-spring support parts 147 are provided on the right surface of the drum support frame 102 in the approximate vertical center thereof. The grid-spring support parts 147 are arranged at intervals in the front-rear direction. Each grid-spring support part 147 has a general cylindrical shape that protrudes rightward from the right surface of the drum support frame 102. The inner diameter of the grid-spring support part 147 is approximately equal to the outer diameter of a grid spring part 164 described later.

As shown in FIG. 17, grid-electrode exposing holes 131 are formed in areas of the drum support frame 102 corresponding to the left endfaces of the grid-spring support parts 147. The grid-electrode exposing holes 131 are generally rectangular in a side view and elongated in the mounting direction X described later. The grid-electrode exposing holes 131 penetrate the drum support frame 102 in the left-right direction.

As shown in FIG. 15, the right end of each grid-spring support part 147 is inserted into the corresponding grid-electrode insertion hole 104.

As shown in FIG. 18, the cleaning-spring support parts 148 are provided on the right surface of the drum support frame 102 in positions slightly below and forward of the corresponding grid-spring support parts 147 with a space, therebetween. The cleaning-spring support pails 148 have a general cylindrical shape that protrudes rightward from the right surface of the drum support frame 102. The inner diameter of the cleaning-spring support parts 148 is approximately equal to the outer diameter of cleaning spring parts 166 described later. The left-right dimension of the cleaning-spring support parts 148 is shorter than the same dimension of the grid-spring support parts 147.

As shown in FIG. 17, cleaning-electrode exposing holes 132 are formed in areas of the drum support frame 102 corresponding to the left endfaces of the cleaning-spring support parts 148 and penetrate the drum support frame 102 in the left-right direction. The cleaning-electrode exposing holes 132 are positioned on the lower front side of the corresponding grid-electrode exposing holes 131 with a space therebetween. The cleaning-electrode exposing holes 132 are generally rectangular in a side view and elongated in the mounting direction X described later.

As shown in FIG. 18, the right end of each cleaning-spring support part 148 is positioned to confront in the left-right direction the corresponding cleaning wire 109 supported on the left surface of the second resin frame 100, with a slight gap formed therebetween.

The wire-spring support parts 149 are disposed on the drum support frame 102 at positions obliquely above and forward of the corresponding grid-spring support parts 147 and are separated therefrom. The wire-spring support parts 149 have a general cylindrical shape that protrudes right ward from the right surface of the drum support frame 102. The inner diameter of the wire-spring support parts 149 is approximately equal to the outer diameter of second wire spring parts 159 described later.

As shown in FIG. 17, wire-electrode exposing holes 140 are formed in areas of the drum, support frame 102 aligned with the left endfaces of the corresponding wire-spring support parts 149. The wire-electrode exposing holes 140 have a general circular shape in a side view and penetrate the drum support frame 102 at positions above and forward of the corresponding cleaning-electrode exposing holes 132.

As shown in FIG. 18, the second transfer-spring support parts 150 are formed on the drum support frame 102 at positions obliquely below and forward of the corresponding cleaning-spring support parts 148 and are separated from the same. The second transfer-spring support parts 150 have a general cylindrical shape that protrudes rightward from the right surface of the drum support frame 102. The inner diameter of the second transfer-spring support parts 150 is approximately equal to the outer diameter of second transfer spring parts 168 described later. The left-right dimension of the second transfer-spring support parts 150 is approximately equal to the same dimension of the cleaning-spring support parts 148.

As shown in FIG. 17, transfer-electrode exposing holes 133 are formed in areas of the drum support frame 102 aligned with the left endfaces of corresponding second transfer-spring support parts 150. The transfer-electrode exposing holes 133 are generally rectangular in a side view and elongated vertically. The transfer-electrode exposing holes 133 penetrate the drum support frame 102 in the left-right direction.

As shown in FIG. 18, the right end of each second transfer-spring support part 150 opposes the distal end of the corresponding transfer wiring part 125 positioned on the left side of the second resin frame 100 and is separated slightly therefrom in the left-right direction.

More specifically, three of the belt-spring support parts 151 are provided on the right surface of the drum support frame 102 at the lower edge thereof. The belt-spring support parts 151 are positioned at the lower rear of the frontmost second transfer-spring support parts 150. The belt-spring support parts 151 have a general cylindrical shape that protrudes rightward from the right surface of the drum support frame 102. The inner diameter of the belt-spring support parts 151 is approximately equal to the outer diameter of belt spring parts 170 described later. The left-tight dimension of the belt-spring support parts 151 is approximately equal to the same dimension of the grid-spring support parts 147.

As shown in FIG. 17, belt-cleaning-electrode exposing holes 134 are formed in areas of the drum support frame 102 corresponding to the left endfaces of the belt-spring support parts 151. The belt-cleaning-electrode exposing holes 134 are positioned below the third fitting hole 130 and arc separated therefrom. Each belt-cleaning-electrode exposing hole 134 is generally rectangular in a side view and elongated vertically. The belt-cleaning-electrode exposing holes 134 penetrate the drum support frame 102 in the left-right direction.

As shown in FIG. 15, the right ends of the belt-spring support parts 151 are inserted into the corresponding belt-electrode insertion holes 121.

Four of the second LED-positioning members 187 are provided at intervals in the front-rear direction to correspond to the four LED units 12. As shown in FIG. 21, the second LED-positioning members 187 are supported on the right surface of the drum support frame 102, with one positioned on the rear side of each second LED groove 136.

Each second LED-positioning member 187 includes a pivoting shaft 188, and a pivoting part 189.

The pivoting shaft 188 has a general columnar shape extending in the left-right direction. The pivoting shaft 188 is supported on the upper rear side of the clamping part 205 so as to be incapable of rotating relative to the clamping part 205. The pivoting part 189 has a general fan shape in a side view, with its front-rear dimension expanding toward the bottom end.

The pivoting part 189 can pivot with its upper end supported on the pivoting shaft 188 so as to be rotatable relative thereto. The second LED-positioning members 187 further includes a spring member (not shown) constantly urging the pivoting part 189 counterclockwise in a left side view so that the front end of the pivoting part 189 is brought into contact with the rear end of the clamping part 205 through the pivoting-part opening 183 formed in the second LED groove 136.

Figure 19:
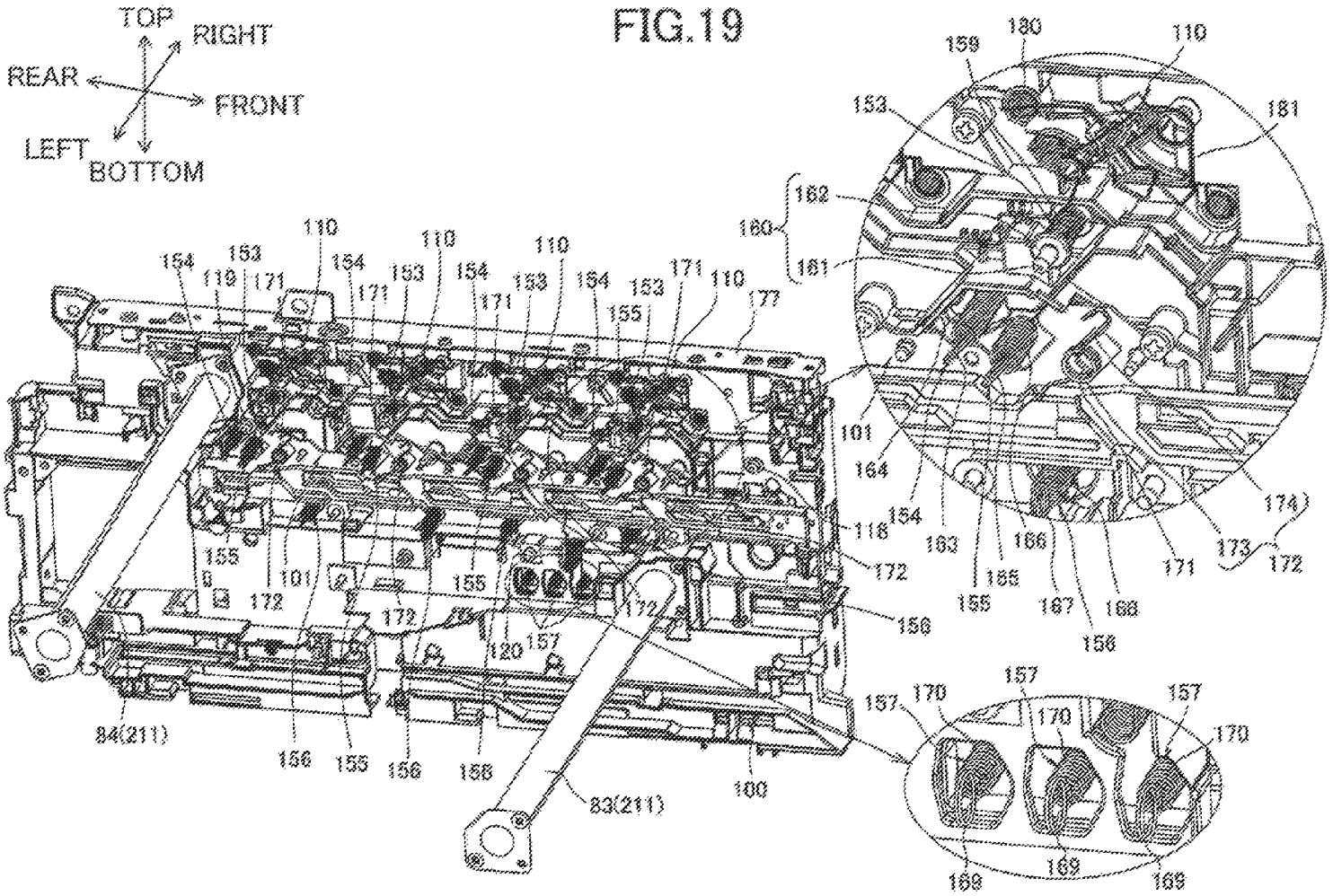
FIG. 19 is a perspective view of the right wall shown in FIG. 15 without the drum support frame as viewed from diagonally forward-left.

As shown in FIG. 19, the drum support frame 102 supports four each of grid electrodes 154, cleaning electrodes 155, wire electrodes 153, and transfer electrodes 156, as well as a plurality of belt-cleaning electrodes 157.

The grid electrodes 154 are formed of an electrically conductive material, such as metal. Each grid electrode 154 is integrally provided with a grid spring part 164, and a grid contact part 163.

The grid spring part 164 has an air-core coil shape extending in the left-right direction. The left-right dimension of the grid spring part 164 is greater than the same dimension of the grid-spring support part 147.

The grid contact part 163 has a general annular shape. The grid contact part 163 is formed continuously with the left end of the grid spring part 164 and protrudes leftward therefrom.

Each grid electrode 154 is supported on the drum support frame 102 by inserting the grid spring part 164 through the corresponding grid-spring support part 147, as shown in FIG. 18, and by inserting the grid contact part 163 through the corresponding grid-electrode exposing hole 131, as shown in FIG. 22. In this state, the right end of the grid spring part 164 in the grid electrode 154 is exposed on the right side of the drum support frame 102, as shown in FIG. 15.

As shown in FIG. 19, the cleaning electrodes 155 are formed of an electrically conductive material, such as metal. Each cleaning electrode 155 is integrally configured of the cleaning spring part 166, and a cleaning contact part 165.

The cleaning spring part 166 has an air-core coil shape extending in the left-right direction. The left-right dimension of the cleaning spring part 166 is slightly larger than the same dimension of the cleaning-spring support part 148.

The cleaning contact part 165 has a general annular shape. The cleaning contact part 165 is formed continuously with the left end of the cleaning spring part 166 and protrudes leftward therefrom.

As shown in FIG. 18, each cleaning electrode 155 is supported on the drum support frame 102 by inserting the cleaning spring part 166 through the corresponding cleaning-spring support part 148, as shown in FIG. 18, and by inserting the cleaning contact part 165 through the corresponding cleaning-electrode exposing hole 332, as shown in FIG. 22. In this state, the right end of the cleaning spring part 166 in the cleaning electrode 155 is in contact with the cleaning wire 109, as shown in FIG. 18.

The wire electrodes 153 are formed of an electrically conductive material, such as metal. As shown in FIG. 19, each wire electrode 153 includes the second wire spring part 159, and a terminal part 160.

The second wire spring part 159 has an air-core coil shape extending in the left-right direction. The left-right direction dimension of the second wire spring part 159 is slightly larger than the same dimension of the corresponding wire-spring support part 149.

The terminal part 160 is formed of an electrically conductive material, such as metal as shown in FIG. 19, the terminal part 160 has a shaft part 161, and a flange part 162. The shaft part 161 has a general columnar shape that extends in the left-right direction. The flange part 162 has a general disk shape and expands radially outward from the outer circumferential surface of the shaft part 161 in the approximate left-right center region thereof. The terminal part 160 is provided on the left end of the corresponding wire electrode 153 by inserting the right end of the shaft part 161 into the internal space of tire second wire spring part 159.

Each wire electrode 153 is supported on the drum support frame 102 by inserting the second wire spring part 159 into the corresponding wire-spring support part 149, as shown in FIG. 18, and by inserting the shaft part 161 of the terminal part 160 into the corresponding wire-electrode exposing hole 140, as shown in FIG. 22. When all wire electrodes 153 are supported on the drum support frame 102, the right end of the second wire spring part 159 constituting the rearmost wire electrode 153 is in contact with the connecting wire 111 of the wire relay electrode 107, while the right ends of the second wire spring parts 159 in other wire electrodes 153 are in contact with the first part 116 of the relay wire 108, as shown in FIG. 18.

As shown in FIG. 19, the transfer electrodes 156 are formed of an electrically conductive material, such as metal. Each transfer electrode 156 is integrally provided with the second transfer spring part 168, and a transfer contact part 167.

The second transfer spring parts 168 have an air-core coil shape expanding in the left-right direction. The left-right dimension of the second transfer spring parts 168 is slightly larger than the same dimension of the second transfer-spring support parts 150.

The transfer contact parts 167 have a general annular shape. The transfer contact parts 167 are formed continuously with the left ends of the corresponding second transfer spring parts 168 and protrude leftward therefrom.

Each transfer electrode 156 is supported on the drum support frame 102 by inserting the second transfer spring part 168 through the corresponding second transfer-spring support part 150, as shown in FIG. 18, and by inserting the transfer contact part 167 through the corresponding transfer-electrode exposing hole 133, as shown in FIG. 22. In this state, the right end of the second transfer spring part 168 constituting the transfer electrode 156 is in contact with the transfer wiring part 125 of the corresponding transfer relay electrode 123, as shown in FIG. 18.

In addition, since the left end of the transfer contact part 167 contacts a transfer roller electrode (not shown), which is electrically connected to the corresponding transfer roller 20, the transfer electrode 156 is electrically connected to the transfer roller 20.

Three of the belt-cleaning electrodes 157 are provided on the drum support frame 102. The belt-cleaning electrodes 157 are formed of an electrically conductive material, such as metal. As shown in FIG. 19, each belt-cleaning electrode 157 includes a belt spring part 170, and the belt contact part 169.

The belt spring part 170 has an air-core coil shape that expands in the left-right direction. The left-right dimension of the belt spring part 170 is larger than the same dimension of the belt-spring support parts 151. The belt contact part 169 has a general annular shape. The belt contact part 169 is formed continuously with the left end of the belt spring part 170 and protrudes leftward therefrom.

Each belt-cleaning electrode 157 is supported on the drum support frame 102 by inserting the belt spring part 170 through the corresponding belt-spring support unit 151, as shown in FIG. 18, and by inserting the belt contact part 169 through the corresponding belt-cleaning-electrode exposing hole 134, as shown in FIG. 22. In this state, the right end of the belt spring part 170 constituting the belt-cleaning electrode 157 is exposed on the right side of the drum support frame 102, as shown in FIG. 15.

Further, since the left end of the belt contact part 169 contacts a belt unit electrode (not shown) provided on the belt-cleaning unit 29 shown in FIG. 1, the belt-cleaning electrode 157 is electrically connected to the belt-cleaning unit 29.

(2-3) Metal Plate

As shown in FIG. 19, a metal plate 101 is fixed to the right surface of the drum support frame 102 in the lower portion thereof. The metal plate 101 is formed of a metal. The metal plate 101 has a generally flat plate shape that is substantially rectangular in a side view and elongated in the front-rear direction.

The metal plate 101 is integrally provided with a plurality of protrusions 171. Specifically, four of the protrusions 171 are provided on the left surface of the metal plate 101 at intervals in the front-rear direction. The protrusions 171 are generally rectangular in a plan view and protrude leftward from the left surface of the metal plate 101.

Four conducting members 172 are also supported on the metal plate 101. The conducting members 172 are formed of an electrically conductive material, such as metal. Each conducting member 172 is integrally provided with a coil part 173, and a shaft contact part 174.

The coil part 173 has an air-core coil shape expanding in the left-right direction. The shaft contact part 174 has a linear shape, extending continuously in a direction obliquely upward and forward from the left end of the coil part 173. Each conducting member 172 is supported on the metal plate 101 by inserting the corresponding protrusion 171 on the metal plate 101 through the coil part 173.

As shown in FIG. 20, the conducting members 172 are arranged between the metal plate 101 and drum support frame 102 and positioned on the lower rear side of the corresponding shaft fitting grooves 142. The shaft contact part 174 of each conducting member 172 extends to a position inside the corresponding shaft fitting groove 142 through the conducting-member exposing hole 143 of the same.

(2-4) Power-Supply Circuit Board

As shown in FIG. 13, a power-supply circuit hoard 175 is provided on the right side of the second resin frame 100 constituting the right wall 42. The power-supply circuit board 175 is an electric circuit hoard provided with a transformer, capacitors, and the like. A voltage supplied from an input power supply (not shown) is amplified by the transformer and then either stored in capacitors or supplied to the various electrodes and wires.

The power-supply circuit board 175 is fixed to the right surface of the second resin frame 100. Thus, the first wire spring part 112, development spring parts 180, grid spring parts 164, belt spring parts 170, and first transfer spring parts 124 are electrically connected to the power-supply circuit hoard 175, with their right ends in contact with the left surface of the power-supply circuit board 175. The relay wire 108 is also electrically connected to the power-supply circuit board 175, with the lower end of the second part 117 contacting the left surface of the power-supply circuit board 175. The cleaning wire 109 is also electrically connected to the power-supply circuit board 175, with the connecting part 127 contacting a cleaning relay electrode (not shown) supported on the power-supply circuit board 175 through the cleaning-wire exposing hole 106.

(3) Reinforcing Unit

As shown in FIG. 8, the reinforcing unit 43 includes a plurality of edge-bridging parts 210, and a plurality of pipes 211. Specifically, four of the edge-bridging parts 210 are provided in the preferred embodiment to connect the corresponding four corners on each of the left wall 41 and the right wall 42 in a side view. The edge-bridging parts 210 include a first bridging part 212 bridging the tipper front corners of the left wall 41 and right wall 42, a second bridging part 213 bridging the upper rear comers, a third bridging part 214 bridging the lower front corners, and a fourth bridging part 215 bridging the lower rear corners.

The first bridging part 212 and the second bridging part 213 are formed of metal and have a general L-shaped cross section. The first bridging part 212 and the second bridging part 213 ate elongated in the left-right direction.

The left and right ends of the first bridging part 212 are fixed to the front edges and upper edges of the respective left wall 41 and the right wall 42, which are generally L-shaped in aside view. The left and right ends of the second bridging part 213 are fixed to the rear edges and upper edges of the respective left wall 41 and right wall 42.

The third bridging part 214 is formed of metal and has a generally flat plate shape elongated in the left-right direction. The left and right ends of the third bridging part 214 are fixed to the bottom and front edges of the left wall 41 and the right wall 42, respectively. The fourth bridging part 215 is formed of metal and is elongated in the left-right direction, with a general C-shaped cross section. As shown in FIG. 5, the left and right ends of the fourth bridging part 215 are fixed to the lower rear corners of the left wall 41 and the right wall 42, respectively.

The pipes 211 are arranged parallel to each other, but are spaced apart in both front-rear and vertical directions. The pipes 211 include a first pipe 83 and a second pipe 84. The first pipe 83 and the second pipe 84 are formed of metal and have a generally cylindrical shape extending in the left-right direction.

As shown in FIG. 7, the left end of the first pipe 83 is fixed to the right surface of the first resin frame 45 constituting the left wall 41 beneath the forwardmost first drum guide part 48. As shown in FIG. 19, the right end of the first pipe 83 is fixed to the left surface of the second resin frame 100 constituting the right wall 42 beneath the front edge of the metal plate 101. Hence, the first pipe 83 bridges the lower front portion on the right surface of the first resin frame 45 with a lower front portion on the left surface of the second resin frame 100, as illustrated in FIGS. 7 and 19.

As shown in FIG. 7, the left end of the second pipe 84 is fixed to the right surface of the first resin frame 45 constituting the left wall 41 on the rear side of the rearmost first drum guide part 48. As shown in FIG. 19, the right end of the second pipe 84 is fixed to the left surface of the second resin frame 100 constituting the right wall 42 above the rear edge of the metal plate 101. Hence, the second pipe 84 bridges the upper rear portion on the right surface of the first resin frame 45 with the upper rear portion on the left surface of the second resin frame 100, as illustrated in FIGS. 7 and 19.

As shown in FIG. 19, the metal plate 101 is disposed between the first pipe 83 and second pipe 84 with respect to both the front-rear direction and the vertical direction.

(4) LED Units, Feeding Mechanism, and Fixing Unit (4-1) LED Units

As shown in FIG. 6, each LED unit 12 includes an LED array 216, and an LED frame 217 for supporting the LED array 216. The LED array 216 constitutes the bottom edge of the LED unit 12. The LED array 216 has a generally flat plate shape that is elongated in the left-right direction and integrally retains a plurality of LEDs arrayed in the left-right direction.

The LED frame 217 constitutes the top portion of the LED unit 12. The LED frame 217 is generally rectangular in a front view and elongated in the left-right direction. The LED frame 217 supports the LED array 216 on its lower edge. The LED frame 217 is provided with a pair of LED protruding parts 218.

As shown in FIGS. 12 and 21, the LED protruding parts 218 are provided on each of the left and right ends of the LED frame 217. The LED protruding parts 218 have a generally flat plate shape, and protrude outward in the left-right direction from the respective left and right ends of the LED frame 217. The LED protruding parts 218 are elongated vertically in cross section.

Each LED unit 12 is supported on the top cover 6 by fixing the top edge of the respective LED frame 217 to the bottom surface of the top cover 6. With this configuration, the LED units 12 move vertically in accordance with the pivotal movement of the top cover 6.

(4-2) Feeding Mechanism

As shown in FIG. 6, the feeding mechanism 36 is provided with a sheet-feed frame 219. The sheet-feed frame 219 has a box-like shape that is generally rectangular in a side view and elongated vertically. The sheet-feed frame 219 supports therein the pickup roller 8, the separating roller 58, the feeding rollers 9, and the registration rollers 10. The sheet-feed frame 219 is further provided with a pair of first sheet-feed bosses 184, and a pair of second sheet-feed bosses 185.

As shown in FIGS. 6, 11, and 12, the first sheet-feed bosses 184 are respectively provided one on each of the left and right endfaces of the sheet-feed frame 219 in the upper sides thereof. The first sheet-feed bosses 184 have a general columnar shape and protrude outward in the left-right direction from the corresponding left and right endfaces of the sheet-feed frame 219.

The second sheet-feed bosses 185 are respectively provided one on each of the left and right endfaces of the sheet-feed frame 219 at positions below and separated from respective first sheet-feed bosses 184. The second sheet-feed bosses 185 have a general columnar shape and protrude outward in the left-right direction from the corresponding left and right endfaces of the sheet-feed frame 219.

The feeding mechanism 36 is disposed between the front ends of the left wall 41 and the right wall 42.

As shown in FIG. 11, the left first sheet-feed boss 184 is inserted through the first sheet-feed boss hole 52 formed in the first resin frame 45 and contacts the front side of the first supply positioning part 63 provided on the metal frame 46. Similarly, the left second sheet-feed boss 185 is fitted into the first sheet-teed boss groove 51 formed in the first resin frame 45 and contacts the rear end of the first sheet-feed boss groove 51 from the front side.

As shown in FIG. 22, the right first sheet-feed boss 184 contacts the second supply positioning part 145 provided on the drum support frame 102 from the front side. Similarly, the right second sheet-feed boss 185 is fitted into the second sheet-feed boss groove 179 formed in the second resin frame 100 and contacts the rear end in the second sheet-feed boss groove 179 from the front side thereof.

Through this configuration, the left and right sides of the feeding mechanism 36 are positioned relative to the front-rear direction and are restricted from moving rearward relative to the left wall 41 and the right wall 42.

(4-3) Fixing Unit

As shown in FIG. 6, the fixing, unit 14 is provided with a fixing frame 220. The fixing frame 220 has a box-like shape that is generally rectangular in a side view. The fixing frame 220 supports the heating roller 21 and the pressure roller 22 internally. The fixing frame 220 is also provided with a pair of fixing bosses 186.

As shown in FIG. 6, the fixing bosses 186 are provided on each of the left and right endfaces of the fixing frame 220 in approximately the center thereof. The fixing bosses 186 have a parallelepiped shape and protrude outward in the left-right direction from the respective left and right endfaces of the fixing frame 220.

The fixing unit 14 is disposed between the rear edges of the left wall 41 and the right wall 42. As shown in FIG. 11, the left fixing boss 186 is inserted through the first fixing-unit boss hole 53 formed in the first resin frame 45 and contacts the first fixing-unit positioning part 64 formed on the metal frame 46 from the rear side thereof. As shown in FIG. 22, the right fixing boss 186 contacts the rear side of the second fixing-unit positioning part 146 provided on the drum support frame 102.

With this configuration, the left and right ends of the fixing unit 14 are positioned relative to the front-rear direction and are restricted from moving forward relative to the left wall 41 and the right wall 42.

4. Operations for Mounting and Removing the Process Cartridges Relative to the Main Casing In order to mount a process cartridge 11 in the main casing 2, the operator places the top cover 6 in the open position (not shown) to expose the access opening 5. Next, the operator inserts the process cartridge 11 into the main casing 2 from above such that the left bearing member 32 is fitted into the corresponding first guiding groove 56 and the right bearing member 32 shown in FIG. 3A is fitted into the corresponding second guiding groove 139, as illustrated in FIGS. 11 and 22.

In this operation, the process cartridge 11 moves in the mounting direction X, which proceeds diagonally downward and rearward, as the left bearing member 32 is guided by the first rail parts 90 and the right bearing member 32 is guided by the second rail parts 137. In other words, the first guiding groove 56 and the second guiding groove 139 guide the process cartridge 11 when the process cartridge 11 is mounted in or removed from the main casing 2. When the left bearing member 32 arrives at the first curved part 91 and the right bearing member 32 arrives at the second curved part 138, the process cartridge H is restricted from moving further downward. At this point, the process cartridge 11 is disposed in its prescribed mounted position. Then, the front first positioning protrusion 61 contacts the left bearing member 32 on the lower from side and the rear first positioning protrusion 61 contacts the left bearing member 32 on the lower rear side. Similarly, the front second positioning protrusion 141 contacts the right bearing member 32 on the lower front side and the rear second positioning protrusion 141 contacts the right bearing member 32 on the lower rear side.

With this configuration, the left end of the photosensitive drum 15, and specifically the left flange member 191, is supported by the pair of first positioning protrusions 61 through the left hearing member 32 as shown in FIG. 11. Similarly, the right end of the photosensitive drum 15, and specifically the right flange member 191, is supported by the pair of second positioning protrusions 141 through the right bearing member 32 as shown in FIG. 22.

At the same time, the right end of the shaft 193 is fitted into the deepest part of the shaft fitting groove 142 and is contacted on the rear side by the shaft contact part 174 of the conducting member 172, as illustrated in FIG. 24. Accordingly, the shaft 193 is electrically connected to the metal plate 101 through the conducting member 172.

As shown in FIG. 20, the power-receiving part 202 of the development electrode member 201 confronts the development-electrode exposing hole 144 in the front-rear direction and is contacted on its rear side by the development contact part 181 of the development electrode 110 through the development-electrode exposing hole 144. In this way, the power-receiving part 202 and development electrode 110 are electrically connected.

As shown in FIGS. 2 and 22, the cartridge-side grid electrodes 95 contact and are electrically connected to the grid contact parts 163 of the grid electrodes 154. Further, the cartridge-side cleaner electrodes 97 contact and are electrically connected to the cleaning contact parts 165 of the cleaning electrodes 155. Further, the cartridge-side wire electrodes 96 contact and are electrically connected to the shaft parts 161 of the corresponding wire electrodes 153.

Accordingly, during an image-forming operation, power generated by the power-supply circuit board 175 can be supplied to the developing rollers 16, the supply rollers 27, the transfer rollers 33, the grids 34, and the cleaning rollers 35.

After the process cartridge 11 is mounted in the main casing 2, the operator moves the top cover 6 from the open position hack to the closed position shown in FIG. 1 to cover the access opening 5. At this time, the LED units 12 move downward as the top cover 6 pivots closed. As a result, the left LED protruding part 218 on each LED frame 217 is inserted between the support part 69 and the head part 77 of the pivoting part 67 from above, as shown in FIG. 12, forcing the pivoting part 67 to rotate clockwise in a right side view against the urging force of the spring member (not shown). Through tins configuration, the left LED protruding part 218 is interposed between the support part 69 and the head part 77 of the pivoting part 67 and fixed in position relative to the front-rear direction.

In addition, the right LED protruding part 218 on the LED frame 217 is inserted between the clamping part 205 and the pivoting part 189 from above, as shown in FIG. 21, forcing the pivoting part 189 to rotate clockwise in a left side view against the urging force of a spring member (not shown). Through this configuration, the right LED protruding part 218 is interposed between the clamping part 205 and the pivoting part 189 and fixed in position relative so the front-rear direction.

In other words, the left end of each LED unit 12, i.e., the left LED protruding part 218, is fixed in position relative to the front-rear direction by the first LED-positioning member 66, and the right end, i.e., the right LED protruding part 218, is fixed, in position relative to the front-rear direction by the second LED-positioning member 187, as illustrated in FIGS. 12 and 21.

Further, both the drum-body couplings 71 and the body-side development couplings 72 are disposed in their advanced positions. Consequently, the drum-body couplings 71 are coupled to the coupling parts 192 of the corresponding left flange members 191 so as to be incapable of rotating relative thereto, and the body-side development couplings 72 are fitted into the coupling recessions 199 of the corresponding development, couplings 197 so as to be incapable of rotating relative thereto. Hence, in an image-forming operation, a rotational drive force can be transmitted from the motor 70 to the left flange members 191 and the development couplings 197.

This completes the operation for mounting a process cartridge 11 in the main casing 2, A process cartridge 11 can be removed from the main casing 2 by performing the above operation in reverse.

5. Operational Advantages (1)In the printer 1 according to the embodiment, one axial end of each photosensitive drum 15 (the left end in the preferred embodiment) is supported in the metal frame 46, which is formed of metal, while the other axial end of each photosensitive drum 15 (the right end in the preferred embodiment) is supported in the drum support frame 102, which is formed of resin, as illustrated in FIGS. 11 and 22. The drive force of the motor 70 is inputted into the left ends of the photosensitive drums 15 through the drum-body couplings 71.

If the frame supporting the left, ends of the photosensitive drums 15 does not have sufficient rigidity, the left ends of the photosensitive drums 15 may not be positioned with sufficient precision relative to the main casing 2. Further, the positional relationships among the photosensitive drums 15 themselves (i.e., the drum pitch) cannot be maintained constant. However, since the metal frame 46 of the printer 1 is formed of metal, the metal frame 46 has sufficient rigidity to maintain the positional relationship of the left ends of the photosensitive drums 15 with good precision. On the other hand, since a drive force is not inputted into the right ends of the photosensitive drums 15, the load, applied to the drum support frame 102 supporting the right ends is smaller than the load applied to the metal frame 46. Hence, the right wall 42 can maintain the positional-relationships of the right ends of the photosensitive drums 15 with good precision, even though the drum support frame 102 is formed of a resin having less rigidity than metal.

In this way, the positional relationships among the photosensitive drums 15 can be maintained constant, while reducing the material costs and weight associated with the printer 1.

(2) As shown in FIG. 15, the drum support frame 102 supports various electrodes connected to tire developer cartridges 25, and specifically supports the grid electrodes 154, the cleaning electrodes 155, the wire electrodes 153, the transfer electrodes 156, and the belt-cleaning electrodes 157. Therefore, it is not necessary to provide a separate structure -from-fee drum support frame 102 for electrically insulating the electrodes, thereby simplifying the structure of the drum support frame 102 or the structure of the electrodes and improving flexibility in laying out the electrodes.

(3) As shown in FIG. 10, Use main casing 2 is further provided with the first resin frame 45, which is formed of a resin material, and is configured to support the metal frame 46, When projected in the left-right direction (i.e., the axial direction of the photosensitive drums 15), the metal frame 46 falls within the projected surface of the first resin frame 45. In other words, the first resin frame 45 is formed larger than the metal frame 46.

Since the metal frame 46 formed of a metal is supported on the first resin frame 45 formed of a resin, only the metal frame 46 supporting one axial end (the left end in the embodiment) of each, photosensitive drum 15 is formed of metal, white part of the main frame member constituting the printer 1 (the first resin frame 45 in the embodiment) can be formed of resin. In this way, the relative positions of the photosensitive drums 15 can be maintained constant, while further reducing material costs and further reducing weight associated with this structure.

(4) As shown in FIG. 9, the support plate 47 is provided on the left surface of the first resin frame 45 constituting the left wall 41. The support, plate 47 includes the motor 70 and the drum-body couplings 71. Hence, both the metal frame 46 and the support plate 47 are supported on the left surface of the first resin frame 45.

Accordingly, this structure can maintain constant positional relationships between the motor 70 and the drum-body couplings 71, and the left flange members 191 on the photosensitive drums 15. Therefore, the drive force from the drive roller 17 can be reliably transmitted to the left flange members 191 of the photosensitive drums 15 via the drum-body couplings 71.

(5) As shown in FIG. 1, each of the photosensitive drums 15 is supported in a corresponding drum cartridge 24, and the drum cartridges 24 are detachable mounted in the main casing 2. Therefore, when a photosensitive drum 15 has reached the end of its life, the user need only replace the process cartridge 11 supporting the photosensitive drum 15 that has reached the end of life. This structure can reduce running costs compared to a structure that does not allow the photosensitive drums 15 to be detachably mounted in the main casing 2.

(6) As shown in FIG. 11, a pair of first positioning protrusions 61 is provided on the metal frame 46 for supporting the left flange member 191 of each photosensitive drum 15 via the corresponding bearing member 32. As shown in FIG. 22, a pair of second positioning protrusions 141 is provided on the drum support frame 102 for supporting the right flange member 191 of each photosensitive drum 15 via the corresponding bearing member 32.

As shown in FIG. 6, the first positioning protrusions 61 and the second positioning protrusions 141 are disposed in positions aligned in the left-right direction as indicated by two-dotted line. Accordingly, when the process cartridge 11 supporting a photosensitive drum 15 is mounted in the main casing 2, the left and right ends of the photosensitive drum 15 can be disposed in positions aligned in the left-right direction. This configuration more reliably maintains constant positional relationships among the photosensitive drums 15.

(7) As shown in FIG. 22, the second guiding grooves 139 are formed in the drum support frame 102 for guiding the right flange members 191 of the photosensitive drums 15 through the corresponding bearing members 32 when the process cartridges 11 supporting the photosensitive drums 15 are mounted in or removed from the main casing 2. This structure ensures that the process cartridges 11 can move smoothly when mounted in or removed from the main casing 2.

Since the drum support frame 102 in which the second guiding grooves 139 are formed is itself formed of resin, both the second guiding grooves 139 and the drum support frame 102 can be integrally formed of resin. Hence, the second guiding grooves 139 can be formed more easily than when the second guiding grooves 139 are formed after first molding the drum support frame 102, thereby reducing manufacturing costs.

(8) As shown in FIGS. 10 and 11, the first guiding grooves 56 are formed in the first resin frame 45 to guide the left flange members 191 on the corresponding photosensitive drums 15 via the bearing members 32 when the process cartridges 11 possessing the corresponding photosensitive drums 15 are mounted in or removed from the main casing 2.

Hence, the first guiding grooves 56 guide the left flange members 191 of the photosensitive drums 15 and the second guiding grooves 139 guide the right flange members 191 of the photosensitive drums 15. This configuration ensures that the process cartridges 11 can be mounted in or removed from the main casing 2 more smoothly.

Most notably, the second guide grooves 139 formed in the drum support frame 46 can facilitate smoother mounting and help removing operations of the photosensitive drums 15 relative to the main casing 2, since one axial end of each photosensitive drum 15 is guided in the corresponding first guide groove 56 while the other axial end is guided in the corresponding second guide groove 139 when the photosensitive drum 15 is mounted in or removed from the main casing 2.

Further, since the first guiding grooves 56 are formed in the first resin frame 45, which is formed of a resin material, both the first guiding grooves 56 and the first resin frame 45 can be integrally formed of resin. This facilitates formation of the first guiding grooves 56, enabling the reduction of manufacturing costs.

(9) As shown, in FIG. 10, the frame openings 60 are formed in the metal frame 46 so as to surround the peripheral edges of the first guiding grooves 56 when projected In the left-right direction. Thus, the metal frame 46 is disposed around the peripheries of the first guiding grooves 56 since the frame openings 60 of the metal frame 46 are formed to surround the edges of the first guiding grooves 56 when viewed in the axial direction. Thus, the metal frame 46 can strengthen the first resin frame 45 supported on the metal frame 46 along the peripheral edges of the first guiding grooves 56, restraining deformation of the first resin frame 45.

(10) As shown in FIG. 11, the distal ends of the first positioning protrusions 61 are positioned inside the first guiding grooves 56 in a left-right projection. Accordingly, when the process cartridge 11 possessing a photosensitive drum 15 is mounted in the main casing 2, the first positioning protrusions 61 on the metal Same 46 can reliably support the left end of the photosensitive drum 15.

More specifically, since this construction positions at least some of the first positioning protrusion 61 or. the metal frame 46 within the first guide grooves 56 when projected in the axial direction of the photosensitive drums 15, the first positioning protrusion 61 can be used as a reference for positioning one axial end of the photosensitive drums 15 when the photosensitive drums 15 are mounted in the main casing 2. Accordingly, the relative positioning of the photosensitive drums 15 can be maintained with precision.

(11) As shown in FIG. 1, the printer 1 includes a plurality of the LED units 12. As shown in FIG. 6, each LED unit 12 has a pair of LED protruding parts 218. As shown in FIG. 11, the first LED-positioning members 66 provided on the metal frame 46 fix the positions of the left LED protruding parts 218 on the LED unit 12 with respect to the front-rear direction. Hence, both the left ends of the LED units 12 and the left ends of the photosensitive drums 15 are fixed in position in the metal frame 46. That is, the first LED-positioning members 66 of the metal frame 46 set the position of one axial end of the LED units 12 in the juxtaposed direction of the LED units 12. Hence, both one axial end of the LED units 12 and one axial end of the photosensitive drums 15 are positioned to the metal frame 46. This construction can improve the precision in positioning the photosensitive drums 15 relative to the LED units 12 corresponding to those photosensitive drums 15 so that the LED units 12 can reliably irradiate light on the photosensitive drums 15.

(12) As shown in FIG. 21, the second LED-positioning members 187 are provided on the drum support frame 102 for positioning the right LED protruding parts 218 of the LED units 12 relative to the front-rear direction. Hence the drum support frame 102 fixes the positions of both the right ends of the LED units 12 and the right ends of the photosensitive drums 15. This construction further improves the precision in positioning the photosensitive drums 15 relative to the LED units 12 corresponding to those photosensitive drums 15.

(13) As shown in FIG. 1, the printer 1 includes the feeding mechanism 36. As shown in FIG. 6, the feeding mechanism 36 has a pair of first sheet-feed bosses 184. As shown in FIG. 11, the left first sheet-feed boss 184 on the feeding mechanism 36 contacts the front side of the first supply positioning part 63 provided on the metal frame 46, fixing the position of the left first sheet-feed boss 184 in the front-rear direction. As shown in FIG. 22, the right first sheet-feed boss 184 on the feeding mechanism 36 contacts the front side of the second, supply positioning part 145 provided on the drum support frame 102, fixing the position of the right first sheet-feed boss 184 in the front-rear direction.

Hence, the metal frame 46 fixes the positions of both the left end of the feeding mechanism 36 and the left ends of the photosensitive drums 15, while the drum support frame 102 fixes the positions of both the right end of the feeding mechanism 36 and the right end of the photosensitive drums 15. Thus, this construction can improve the position of the feeding mechanism 36 relative to each of the photosensitive drums 15, ensuring that sheets can be reliably supplied from the feeding mechanism 36 toward the photosensitive drums 15.

(14) As shown in FIG. 1 the printer 1 also includes a fixing unit 14. As shown in FIG. 6, the fixing unit 14 has a pair of fixing bosses 186. As shown in FIG. 11, the left fixing boss 186 on the fixing unit 14 contacts the rear side of the first fixing-unit positioning part 64 provided on the metal frame 46 fixing the position of the fixing boss 186 in the front-rear direction. As shown in FIG. 22, the right fixing boss 186 on the fixing unit 14 contacts the rear side of the second fixing-unit positioning part 146 provided on the drum support frame 102, fixing the position of the right fixing boss 186 in the front-rear direction, Hence, the metal frame 46 fixes the positions of both the left end of the fixing unit 14 and the left ends of the photosensitive drums 15, while the drum support frame 102 fixes the positions of both the right end of the fixing unit 14 and the right ends of the photosensitive drums 15, Accordingly, this construction can improve the precision in positioning the fixing unit 14 relative to the photosensitive drums 15, ensuring that toner images transferred from the peripheral surfaces of the photosensitive drums 15 onto a sheet S can be reliably fixed to the sheet S.

(15) As shown in FIG. 22, the right wall 42 of the main casing 2 includes the second resin frame 100, which is formed of resin and configured to support the drum support frame 102, The drum support frame 102 is arranged so that its surface projected in the left-right direction falls within the projected surface of the second resin frame 100. Hence, both the drum support frame 102 and the second resin frame 100 can be formed of a suitable resin material. Since the drum support frame 102 and the second resin frame 100 can be molded separately, the components can be molded more easily when the drum support frame 102 and the second resin frame 100 are integrally molded, thereby reducing manufacturing costs.

(16) The drum support frame 102 is formed of a resin, such as glass fiber reinforced polycarbonate having a lower coefficient of thermal expansion than the second resin frame 100. Since the drum support frame 102 supporting the right ends of the photosensitive drums 15 has a lower coefficient of thermal expansion than the second resin frame 100, warping or other deformation caused by changes in temperature can be more easily suppressed in the drum support frame 102 than the second resin frame 100. This construction avoids a drop in the precision of positioning the right ends of she photosensitive drums 15 supported in the drum support frame 102 relative to the main casing 2. As a result, this configuration reliably maintains a constant positional relationship among the plurality of photosensitive drums 15.

Further, resin with a lower coefficient of thermal expansion is generally more expensive than resin with a higher coefficient of thermal expansion. Since only the drum support frame 102 supporting the right ends of the photosensitive drums 15 (i.e., the right flange members 191) is formed of a more expensive resin, while the other supporting members are formed of a less expensive resin, this configuration helps to further reduce manufacturing costs.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a casing including a first frame, a second frame, and a third frame of resin, the third frame being configured to support the first frame;

a plurality of photosensitive drums configured to rotate about an axis line extending in an axial direction and juxtaposed at intervals in the casing, the casing defining one side and the other side in the axial direction, drive force for rotating the plurality of photosensitive drums being inputted to the one side of the plurality of photosensitive drums;

a plurality of developing devices provided to correspond to the plurality of photosensitive drums and configured to supply developing agent to the corresponding photosensitive drums; and a support plate supporting a drive source configured to generate the drive force and a rotational member configured to transmit the drive force from the drive source to the one side of the plurality of photosensitive drums, the support plate being made of metal and supported on the third frame, wherein the first frame is made of metal and is configured to support the one side of each of the plurality of photosensitive drums, and the second frame is made of resin and is configured to support the other side of each of the plurality of photosensitive drums, wherein when projected in the axial direction, the first frame has a first projected surface and the third frame has a second projected surface in the axial direction, the first projected surface falling within the second projected surface as viewed in the axial direction.

2. The image forming apparatus according to claim 1, wherein the second frame supports an electrode configured to be in electrical connection with the developing device.

3. The image forming apparatus according to claim 1, wherein each of the plurality of photosensitive drums is configured to be detachably mounted in the casing, wherein the first frame is provided with a first support portion configured to support the one side of the plurality of photosensitive drums when the photosensitive drums are mounted, wherein the second frame is provided with a second support portion configured to support the other side of the plurality of photosensitive drums when the photosensitive drums are mounted.

4. The image forming apparatus according to claim 3, wherein the first support portion is aligned with the second support portion when projected in the axial direction.

5. The image forming apparatus according to claim 3, wherein the second frame is formed with a second guiding groove for guiding the other side of the photosensitive drum when the photosensitive drum is attached to and detached from the casing.

6. The image forming apparatus according to claim 3, wherein the third frame is formed with a third guiding groove for guiding the one side of the photosensitive drum when the photosensitive drum is attached to and detached from the casing.

7. The image forming apparatus according to claim 6, wherein the first frame is formed with an opening so as to surround a peripheral edge of the third guiding groove when projected in the axial direction.

8. The image forming apparatus according to claim 6, wherein at least a part of the first support portion falls within the third guiding groove when projected in the axial direction.

9. The image forming apparatus according to claim 3, wherein the support plate is supported on the third frame as a separate member.

10. The image forming apparatus according to claim 1, wherein the casing further includes a fourth frame made of resin and configured to support the second frame, wherein when projected in the axial direction, a projected surface of the second frame falls within a projected surface of the fourth frame.

11. The image forming apparatus according to claim 10, wherein the second frame has a lower coefficient of thermal expansion than that of the fourth frame.

12. An image forming apparatus comprising:

a casing including a first frame, a second frame, and a third frame of resin, the third frame being configured to support the first frame;

a plurality of photosensitive drums configured to rotate about an axis line extending in an axial direction and juxtaposed at intervals in the casing, the casing defining one side and the other side in the axial direction, drive force for rotating the plurality of photosensitive drums being inputted to the one side of the plurality of photosensitive drums;

a plurality of developing devices provided to correspond to the plurality of photosensitive drums and configured to supply developing agent to the corresponding photosensitive drums; and an exposing unit provided to correspond to the plurality of photosensitive drums and configured to expose the photosensitive drum, wherein the first frame is made of metal and is configured to support the one side of each of the plurality of photosensitive drums, and the second frame is made of resin and is configured to support the other side of each of the plurality of photosensitive drums, wherein when projected in the axial direction, the first frame has a first projected surface and the third frame has a second projected surface in the axial direction, the first projected surface falling within the second projected surface as viewed in the axial direction, and wherein the first frame includes a first exposure positioning member configured to fix a position of the one side of the exposing unit in an arrangement direction of the plurality of photosensitive drums.

13. The image forming apparatus according to claim 12, wherein the second frame includes a second exposure positioning member configured to fix a position of the other side of the exposing unit in the arrangement direction.

14. An image forming apparatus comprising:

a casing including a first frame, a second frame, and a third frame of resin, the third frame being configured to support the first frame;

a plurality of photosensitive drums configured to rotate about an axis line extending in an axial direction and juxtaposed at intervals in the casing, the casing defining one side and the other side in the axial direction, drive force for rotating the plurality of photosensitive drums being inputted to the one side of the plurality of photosensitive drums;

a plurality of developing devices provided to correspond to the plurality of photosensitive drums and configured to supply developing agent to the corresponding photosensitive drums; and a feeding unit configured to feed a sheet to the photosensitive drum, wherein the first frame is made of metal and is configured to support the one side of each of the plurality of photosensitive drums, and the second frame is made of resin and is configured to support the other side of each of the plurality of photosensitive drums wherein when projected in the axial direction, the first frame has a first projected surface and the third frame has a second projected surface in the axial direction, the first projected surface falling within the second projected surface as viewed in the axial direction, and wherein the first frame is provided with a first supply positioning part configured to fix a position of the one side of the feeding unit in an arrangement direction of the plurality of photosensitive drums, wherein the second frame is provided with a second supply positioning part configured to fix a position of the other side of the feeding unit in the arrangement direction.

15. An image forming apparatus comprising:

a casing including a first frame, a second frame, and a third frame of resin, the third frame being configured to support the first frame;

a plurality of photosensitive drums configured to rotate about an axis line extending in an axial direction and juxtaposed at intervals in the casing, the casing defining one side and the other side in the axial direction, drive force for rotating the plurality of photosensitive drums being inputted to the one side of the plurality of photosensitive drums;

a plurality of developing devices provided to correspond to the plurality of photosensitive drums and configured to supply developing agent to the corresponding photosensitive drums; and a fixing unit configured to fix a developing agent image on a sheet, wherein the first frame is made of metal and is configured to support the one side of each of the plurality of photosensitive drums, and the second frame is made of resin and is configured to support the other side of each of the plurality of photosensitive drums, wherein when projected in the axial direction, the first frame has a first projected surface and the third frame has a second projected surface in the axial direction, the first projected surface falling within the second projected surface as viewed in the axial direction, wherein the first frame is provided with a first fixing unit positioning part configured to fix a position of the one side of the fix unit in an arrangement direction of the plurality of photosensitive drums, and wherein the second frame is provided with a second fixing unit positioning part configured to fix a position of the other side of the fixing unit in the arrangement direction.

* * * * *